United States Patent [19]

Adamache et al.

[11] Patent Number: 4,988,389

[45] Date of Patent: Jan. 29, 1991

[54] EXPLOITATION METHOD FOR RESERVOIRS CONTAINING HYDROGEN SULPHIDE

[76] Inventors: Ion-Ionel Adamache, 330-26 Avenue S.W., Apt. 302, Calgary, Alberta, Canada, T2S 2T3; William L. Kennedy, 24 Stradbrooke Way S.W., Calgary, Alberta, Canada, T3H 1S4; Michael C. Enwright, 32 Hawksley Crescent N.W., Calgary, Alberta, Canada, T3G 3B9

[21] Appl. No.: 364,474

[22] Filed: Jun. 12, 1989

Related U.S. Application Data

[63] Continuation-in-part of Ser. No. 248,191, Sep. 23, 1988, abandoned.

[30] Foreign Application Priority Data

Oct. 2, 1987 [CA] Canada ..... 548468

[51] Int. Cl.[5] ..... E21B 43/00; E21B 37/06

[52] U.S. Cl. ..... 166/302; 166/304; 166/310; 166/313; 166/370; 166/60; 166/61; 166/62; 166/105; 166/106; 166/902

[58] Field of Search ..... 166/250, 902, 302, 303, 166/304, 310, 312, 313, 369, 370, 372, 60, 61, 62, 66, 105, 106, 267, 268, 321; 417/76, 77, 151, 160, 172, 196

[56] References Cited

U.S. PATENT DOCUMENTS

| | | | |
|---|---|---|---|
| 1,150,473 | 8/1915 | Wiseley | 417/151 |
| 2,268,978 | 1/1942 | White | 166/62 |
| 2,893,490 | 7/1959 | Williams et al. . | |
| 3,212,450 | 10/1965 | Castellot | 417/160 |
| 3,223,156 | 12/1965 | Peter | 166/310 |
| 3,372,753 | 3/1968 | Tuttle et al. | 166/370 |
| 3,393,733 | 7/1968 | Kuo et al. | 166/267 |
| 3,531,160 | 9/1970 | Fisher | 299/5 |
| 3,545,886 | 12/1970 | Chalom | 417/151 |
| 3,846,311 | 11/1974 | Sharp et al. | 166/312 |
| 3,909,422 | 9/1975 | Sample, Jr. | 166/312 |
| 4,290,900 | 9/1981 | Sharp et al. | 166/312 |
| 4,390,061 | 6/1983 | Short | 166/53 |
| 4,501,323 | 2/1985 | Lively et al. | 166/902 |
| 4,503,913 | 3/1985 | Carmody | 166/319 |
| 4,603,735 | 8/1986 | Black | 166/372 |
| 4,605,069 | 8/1986 | McClaflin et al. | 166/310 |
| 4,716,960 | 1/1988 | Eastlund et al. | 166/62 |
| 4,723,890 | 2/1988 | Corteville et al. | 417/151 |

FOREIGN PATENT DOCUMENTS

| | | |
|---|---|---|
| 415120 | 5/1943 | Canada . |
| 741428 | 8/1966 | Canada . |
| 953643 | 8/1974 | Canada . |
| 1132785 | 10/1982 | Canada . |
| 1179251 | 12/1984 | Canada . |
| 1185519 | 4/1985 | Canada . |

OTHER PUBLICATIONS

Teevens, "Corrosion Control . . . for Sour Gas Wells", Corrosion, Paper #47, Mar. 1957.

SPE 15177 (Christ et al.) "Obtaining Low Bottom Hole Pressures in Deep Wells . . .", May 1986.

*Primary Examiner*—Bruce M. Kisliuk

*Attorney, Agent, or Firm*—Parkhurst, Wendel & Rossi

[57] ABSTRACT

A method of producing fluids from subterreanean reservoirs containing hydrogen sulphide and especially those reservoirs where elemental sulphur or hydrogen polysulphides are present. The method describes the use of a jet pump, chemical injection, and downhole electrical heaters to prevent the deposition of elemental sulphur within the production tubulars of wells penetrating such reservoirs by raising the pressure, temperature, and sulphur solvency of fluids being produced up these wells. In this way, subterranean reserves of sulphur and hydrogen sulphide which were previously unproducible or too expensive to produce can be commercially exploited.

34 Claims, 13 Drawing Sheets

• DENOTES EXAMPLES OF POSSIBLE WELLHEAD CONDITIONS

EXPLOITATION METHOD FOR RESERVOIRS CONTAINING HYDROGEN SULPHIDE

This is a continuation-in-part of application Ser. No. 07/248,191, filed Sept. 23, 1988 now abandoned.

FIELD OF THE INVENTION

This invention pertains to a method of producing fluids from subterranean reservoirs containing hydrogen sulphide and, more specifically, for exploiting reservoirs containing hydrogen sulphide and sulphur, physically dissolved, chemically bound (e g. hydrogen polysulphides), or existing as elemental sulphur in a solid or liquid state in the reservoir fluid, which is prone to sulphur deposition phenomena and/or production problems due to high viscosity of downhole well fluids, and also for improving overall recovery of the above defined subterranean resources.

DESCRIPTION OF THE PRIOR ART

The production and testing of subterranean reservoirs containing hydrogen sulphide and other associated naturally occurring fluid components such as hydrocarbons, $CO_2$ and $N_2$ and more specifically those with sulphur, physically dissolved, chemically bound (eg. hydrogen polysulphide), or existing as elemental sulphur in a solid or liquid state in the reservoir fluid, said fluid being prone to sulphur deposition problems and other production problems due to the high viscosity of these downhole fluids, has led to sulphur deposition problems in the surface facilities, tubing, wellbore, the zone adjacent to the wellbore and in the reservoir. It is known that the amount of sulphur that is present in the sour gas increases with the concentration of $H_2S$. Also, the formation of hydrates and corrosion problems have been observed during the testing of wells with such reservoirs.

When the reservoir fluid containing hydrogen sulphide leaves the formation and flows up the tubing, there is normally a gradual temperature decrease coupled with a pressure decrease. The fluid flow trajectory shown in a conceptual phase behaviour diagram (FIG. 1) is typified by line a. Furthermore, if the well does not flow naturally, the problem is more complicated because an artificial lift installation will be required at a particular depth, depending on the specific conditions. Deposition of elemental sulphur can occur due to changes in physical solubility of sulphur in the reservoir fluid as a result of changes in temperature and pressure during production. Sulphur can also be released by the decomposition of polysulphides as a result mainly of the charge of the equilibrium between hydrogen sulphide and polysulphide existing in the reservoir. Other factors, water content for example, may also affect this equilibrium. These phenomena can lead to flow restrictions in the surface facilities, tubing, wellbore, the zone adjacent to the wellbore and in the reservoir. When the trajectory of the flow located in the above-mentioned phase behaviour diagram enters the two-phase region (particularly when the trajectory crosses the bubble point curve), the sulphur deposition could be aggravated by cooling effects occurring in a two-phase flow regime.

The following describes the industry state of the art, and reference is made to several patents pertaining to the sulphur deposition problems:

(a) A typical downhole configuration used at wells prone to sulphur deposition has been comprised of three parallel tubing strings: a heater string to circulate hot fluid down the tubing and up the casing annulus, an injection string for circulating heated fluids (such as oil or solvent) and a producing string through which the reservoir fluids are commingled with the injected fluids and produced to the surface. Temperature and pressure are not adequately maintained to prevent sulphur deposition from the perforated zone up to the wellhead. The consequences arising from this situation include plugged off tubing, plugged off surface facilities, and flow restrictions. Consequently, for fluids flowing from the perforated zone, through specifically engineered downhole completion equipment to the wellhead, it has been considered advantageous to avoid a flow trajectory which passes through the two phase region of a phase diagram. This objective is difficult to achieve with the typical downhole configuration described previously. Another disadvantage of this downhole configuration arises from the need for complicated surface facilities to handle three different fluids: heater string fluids, heated injected string fluids, and fluids from the producing string.

For small diameter casing, a single tubing string and packer was used with a chemical injection valve installed above the packer. This downhole configuration fails to impede sulphur deposition in the tailpipe and in the casing below the packer, and also eliminates the possibility of corrosion mitigation below the packer.

In another downhole configuration, the injection of the inhibitor was performed through the packer. The chemicals were pumped from the surface down the annular space through a chemical injection valve assembly and through the packer. Similarly, it was suggested that sulphur solvents could be injected through the above mentioned valve, using the annular space as a conduit. This downhole configuration has the disadvantage that the annulus must be filled with the chemicals to be injected (the annular volume exceeds 100 $m^3$ in some cases) Hydrate temperature depressants were injected down through a separate chemical injection tubing, which was connected to the main production tubing at an approximate depth of 950 m.

(b) The U.S. Pat. No. 3,393,733 of C. H. Kuo et al., proposes the injection of a heated fluid miscible with the reservoir fluid in the wellbore above a packer set above the perforated zone so as to dissolve sulphur as the heated fluid and the reservoir fluid are produced up the tubing, thus eliminating potential sulphur depositions in the tubing above the packer This method has the following disadvantages: the injected miscible fluid increases the hydrostatic fluid gradient, thus exerting a higher back-pressure on the formation and subsequently diminishing the inflow from the resevoir. In cases where the solvent is to be regenerated for reuse, separation equipment is required which can increase the operating costs. Also, this method fails to remove any sulphur which may have deposited below the packer.

(c) Canadian Patent No. 953,643 of J. R. Eickmeier proposes to reduce sulphur precipitation by circulating a hot fluid (e.g. steam) down an insulated tubing string, up the casing-production tubing annulus to increase the temperature of fluids in the production tubing from the outside. This patent states that it is preferable to simultaneously inject a hot oil into the produced fluid adjacent to the productive interval using a separate tubing so as to dissolve precipitated sulphur and/or prevent sulphur deposition on the inside of the producing tubing string, through the mixing of the hot oil with the produced fluid. Consequently, this patent has a disadvantage in that it requires the use of three strings: one heater string, one producing string and one hot oil injection string, together with all necessary surface facilities to handle three different types of fluids: steam, hot oil and produced fluids. The difference between the state of the art described in point (a) and Canadian Patent No. 953,643 is in the length of the heater string and the fluid circulated. In Canadian Patent No. 953,643, mainly steam is circulated and the heater string extends down to the packer, compared with the status of the art in (a) where the heater string is shorter and mainly hot oil or hot water is circulated (d) In 1962, Canterra Energy Ltd.'s (CEL) predecessor, Texas Gulf Sulphur Company Inc., drilled, completed and tested a sour gas well, 5-23-30-11 W5M Panther River.

The above well (FIG. 2) is an example of the sulphur plugging problems that have occurred in wells equipped in the manner of the prior art. A production test was carried out from 1962—December 11, through 1963—January 19. The main characteristics of the productive formation are listed below:

Productive Formation: Wabamun
Depth: 3261.4 to 3272.6 m
Formation Pressure: 25932 kPa
Formation Temperature: 79.4° C.
Gas Composition: 68.0% $H_2S$, 9.4% $CO_2$ (Mole Percent); 21.4% $CH_4$ and 1.2% $N_2$
Sulphur Content: 9.5–13.0 kg/1000 SCM The well was equipped with a heater string 23 of 42 mm diameter, 912 m in length, and a 73.0 mm tubing string 9 was extended to the level of perforations at 3271.7 m. A permanent packer 10 was set above the productive formation 1. The 73 mm tubing was internally plastic lined to reduce the pipe roughness and avoid sulphur build-up on the tubing walls. The Wabamun zone was perforated and stimulated after which the production test commenced.

The reservoir fluids flowed from the perforations into the tailpipe 8 and up the production tubing 9 to surface. These fluids cooled as they flowed up the well. The fluids were indirectly heated when they reached the depth of the heater string 23 at 912 m in order to increase the fluid temperature above the hydrate formation temperature. Under these conditions the well could only be flowed sporadically for a total of 44 hours during a ten day period. The peak flow rate was only 42000 standard cubic meters per day (SCM/day) and lasted for only 3 hours. The average rate was less than 24000 SCM/day. Typically, it was indicated downhole sulphur plugging. Sulphur bridges at depths ranging from 632.4 m to 2682.1 m were confirmed on three separate occasions. Two treatments with carbon disulphide sulphur solvent were required.

Later in the second stage of the test, a 48.3 mm OD tubing string 3, extended to 3176.3 m, was installed concentrically in the 73 mm tubing. Carbon disulphide, diesel fuel, nitrogen, and methanol were periodically injected down the annular space between the 73 mm tubing and 48.3 mm tubing. The injected fluids commingled with the reservoir fluids at the bottom of the innermost 48.3 mm tubing at 3176.3 m. All the fluids were produced up the inner 48.3 mm tubing. The well was produced again sporadically for a total of 20 hours over an eight day period with an average rate of 32000 SCM/day. Most of the flow periods were limited to less than 3 hours, because of indications of downhole sulphur deposition and hydrate formation in the inner string.

Due to the sulphur deposition problems experienced during the testing, the well was suspended in 1963 until the technology would become available for production of such a reservoir.

Jet pumps have been applied to improve production from oil and water wells as well as for dewatering gas wells. The application of jet pumping in wells in which the gas contains hydrogen sulphide in the presence of carbon dioxide was initiated by Canterra Energy Ltd. (CEL). The following describes the state of the art and patents pertaining to jet pumping:

(a) Canadian Patent No. 1,179,251, Canalizo, advocates the use of a reverse flow jet pump and describes its construction without addressing problems of well production due to sulphur deposition. This patent does not recommend any specific power fluid.

(b) U.S. Pat. No. 3,887,008, Canfield, advocates the use of a reverse flow jet pump to lift liquids, principally water, from gas wells which cannot flow due to the presence of a liquid phase. This technique does not address the problem associated with sulphur deposition.

SUMMARY OF THE INVENTION

Figure 1:
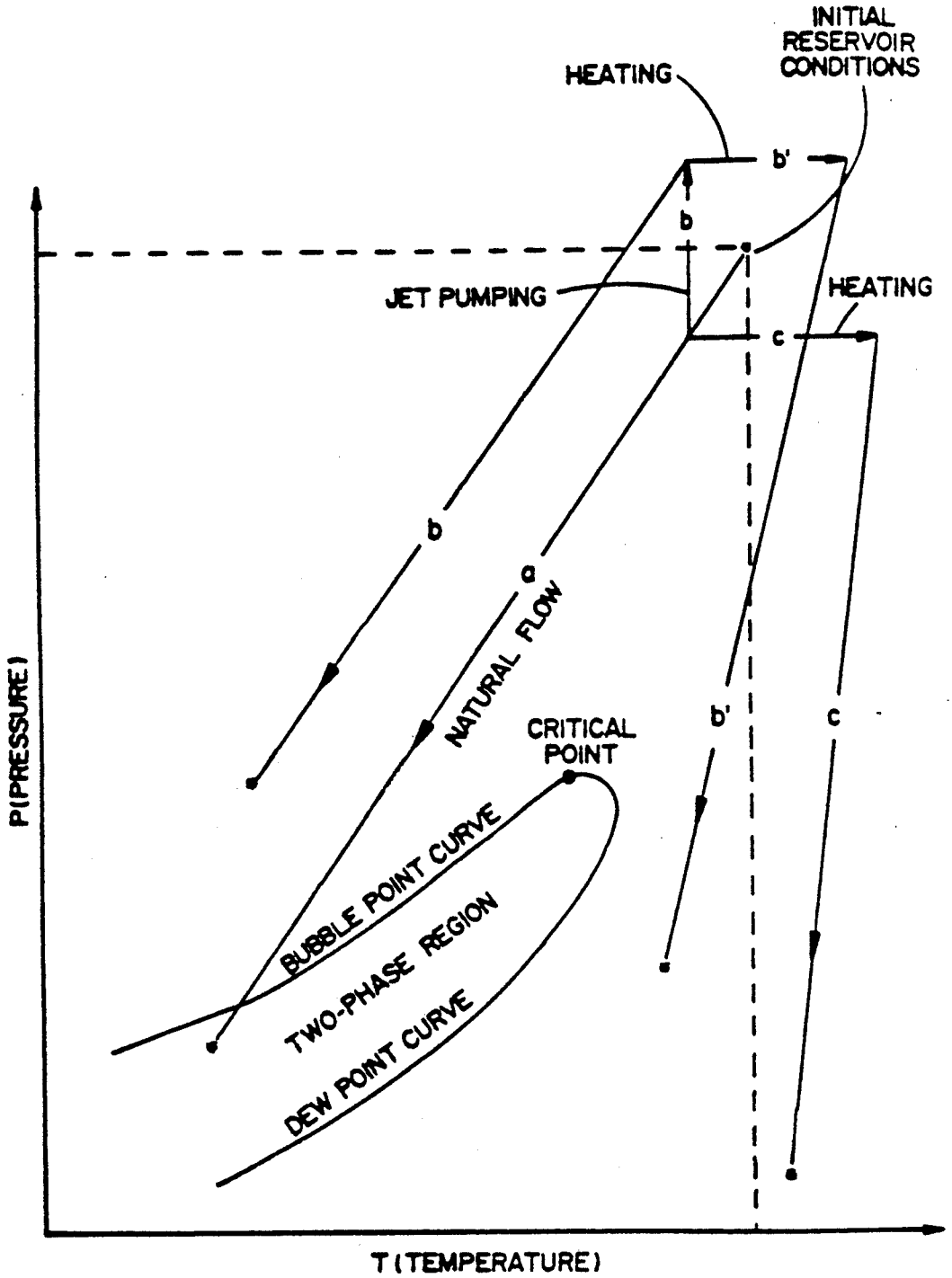
FIG. 1 is an undimensioned pressure and temperature graph showing various pressure-temperature paths for hydrogen sulphide fluids being produced from a subterranean reservoir to the surface.

The present invention provides a unique system of producing fluids from subterranean reservoirs containing hydrogen sulphide, and more specifically for exploiting reservoirs containing hydrogen sulphide and sulphur, physically dissolved, chemically bound (eg. hydrogen poly-sulphides), or existing as elemental sulphur in a solid or liquid state in the reservoir fluid, which is prone to sulphur deposition phenomena and/or production problems due to high viscosity of downhole well fluid and also for improving the overall recovery of the above defined resources by using a jet pump system which provides additional pressure, heat, and solvent for the prevention of sulphur deposition during the lifting of the produced fluids to the surface.

The jet pump provides means of obtaining a drawdown of the formation pressure and permits the exploitation of reservoirs containing hydrogen sulphide. This is achieved by using a power fluid pumped down through an independent pathway and through a nozzle assembly within the jet pump. After passing through the nozzle, the power fluid enters a mixing chamber at high velocity and reduced pressure such that it entrains the produced fluids containing hydrogen sulphide. Afterwards, the commingled fluids pass through the throat and then into the diffuser where the velocity of the fluids decreases and the pressure increases to a value above that which occurs in the mixing chamber and the productive interval. This pressure is sufficient to expel the commingled fluids from the jet pump and cause them to flow to the surface through the production tubing. In a preferred embodiment the jet pump power fluid injected downhole is heated.

An important feature of the invention is a packer for isolating the formation from the upper part of the casing having a permanent tailpipe or a stung-through tailpipe and accommodating flow-through connections for chemical injection tubing. In this manner, a very effective system for circulating chemicals, especially sulphur solvents, is included in the downhole configuration, permitting the prevention of sulphur precipitation or injection of a chemical or of a chemical mixture along or into the perforated interval when required. The chemical mixture can contain one or more of the following: sulphur solvent, corrosion inhibitor, hydrate temperature depressants.

In another embodiment, the jet pump is part of a dual tubular downhole configuration. One tubular section is for production (jet pumping) and would be comprised of a pair of parallel or concentric tubing strings. The second, auxiliary tubular section is for multipurpose use (typically downhole heating) and could be comprised of a single tubing string or a pair of tubing strings arranged concentrically or in parallel. This system can be adapted for any type of well completion, such as: cased hole, open hole, vertical, deviated or horizontal hole. Typical production problems, such as sulphur precipitation, hydrate formation, and corrosion are reduced or eliminated. It permits the application of various techniques such as bottom hole heating instead of conventional surface heating, natural flow, artificial lift, and full depth circulation of different hot fluids and solvents, cyclical/intermittent/pulsing production associated with stimulation techniques, such as acidizing, fracturing, injection into the formation of hot fluids or a combination of these and reservoir pressure maintenance for a higher recovery factor. In this system, the reservoir fluids can be produced by increasing the bottom hole temperature through the application of heat downhole.

In another embodiment, electrical heating would be applied by heaters powered by cable or by a concentric tubing string providing an electrical circuit downhole. In this manner, the downhole fluid temperature is increased without having the usual separate heater string. The heating system should provide the supplementary heat to maintain the fluids in the range of temperatures chosen in accordance with the sulphur solubility and phase behaviour for that particular well-reservoir system (refer to the exemplified trajectories: b', and c of FIG. 1).

The present invention, therefore, in one broad aspect thereof, provides a method of producing fluids comprising sulphur and hydrogen sulphide from a subterranean reservoir containing said fluids, via a well penetrating said reservoir, said hydrogen sulphide being present as hydrogen sulphide and/or one or more chemical compositions which break down to release hydrogen sulphide, which method comprises:

(a) providing said well with a producing interval in contact with the fluids to be produced, (b) installing a jet pump downhole in said well, said jet pump having an inlet for fluid to be pumped, an inlet for power fluid, and an outlet, said jet pump being installed so that the inlet for fluid to be pumped is in contact with said fluids to be produced;

(c) providing a direct fluid connection from said outlet to the wellhead;

(d) providing a direct fluid connection from the wellhead to the inlet for power fluid, and (e) supplying power fluid from the wellhead to said jet pump through said second-mentioned fluid connection to drive said jet pump and thereby to produce through said first-mentioned fluid connection from the outlet of said jet pump to the surface an admixture of power fluid and the fluids to be produced, said method being characterized in that pressurizing action of said jet pump driven by said power fluid in the presence of hydrogen sulphide operates to retain sulphur in a non-plugging state within the admixed fluids, said admixture of fluids having enhanced sulphur dissolving capacity, and in that a liquid film is formed on the inner surface of said fluid connection from said jet pump outlet to the wellhead, said liquid film impeding deposition of sulphur upon the inner surface of said fluid connection from the jet pump outlet to the wellhead, whereby sulphur deposition and/or plugging within said last-mentioned fluid connection is substantially prevented.

In another broad aspect, the present inventions resides in a method for the production of fluids containing hydrogen sulphide and sulphur, said fluids being prone to sulphur deposition and production problems due to the .high viscosity thereof, from a subterranean reservoir containing said fluids, via a well penetrating said reservoir, said method of production comprising:

(a) providing said well with two independent fluid pathways, one for the injection of a power fluid, and a second for the production of reservoir fluids mixed with said power fluids;

(b) providing said well with a jet pump, said jet pump being installed downhole in operative communication with said fluid pathways in the wellbore;

(c) injecting said power fluid into the first-mentioned of said fluid pathways in the well, and thence into said jet pump: and (d) driving said jet pump with said injected power fluid, said jet pump driven by said injected power fluid lifting the produced fluids containing hydrogen sulphide and sulphur from said reservoir to the surface through said second fluid pathway, said method being characterized in that pressurizing action of said jet pump driven by said injected power fluid in the presence of hydrogen sulphide operates to retain sulphur in a physically dissolved, chemically bound, or other non-plugging state within the admixed fluids, said admixture of fluids having enhanced sulphur dissolving capacity, and in that a liquid film is formed on the inner surface of said second fluid pathway from the outlet of said jet pump to the surface, said liquid film impeding deposition of sulphur upon the inner surface of said second fluid pathway, whereby sulphur deposition and/or plugging within said second fluid pathway is substantially prevented.

The present invention further resides broadly in a method for the production of fluids containing hydrogen sulphide and sulphur, said fluids being prone to sulphur deposition or production problems due to the high viscosity thereof from a subterranean reservoir containing said fluids via a well penetrating said reservoir, said method of production comprising:

(a) providing said well with two concentric tubing strings in the wellbore, to provide two independent fluid pathways, one for the injection of a power fluid, and a second for the production of reservoir fluids mixed with said power fluid;

(b) providing said well with a jet pump, said jet pump being installed downhole within the inner tubing string for the purpose of lifting the fluids to the surface through said inner tubing string:

(c) providing said well with an annular seal between a casing and the outer tubing installed in said wellbore above a productive interval of said subterranean reservoir:

(d) injecting said power fluid into the annulus between the concentric tubing strings; and (e) driving said jet pump with said injected power fluid, said power fluid being injected from the surface entering said jet pump from the inner annulus between the concentric tubing strings, said jet pump driven by said injected power fluid lifting said produced fluids containing hydrogen sulphide and sulphur from said reservoir to the surface through the inner tubing, said method being characterized in that pressurizing action of said jet pump driven by said injected power fluid in the presence of hydrogen sulphide operates to retain sulphur in a physically dissolved, chemically bound, or other non-plugging state within the admixed fluids, said admixture of fluids having enhanced sulphur dissolving capacity, and in that a liquid film is formed on the inner surface of said inner tubing string said liquid film impeding deposition of sulphur upon the inner surface of said inner tubing string, whereby sulphur deposition and/or plugging within said inner tubing string is substantially prevented.

The present invention further provides a method for the production of fluids containing hydrogen sulphide and sulphur, said fluids being prone to sulphur deposition or production problems due to the high viscosity thereof, from a subterranean reservoir containing said fluids, via a well penetrating said reservoir, said method of production comprising:

(a) providing said well with two concentric tubing strings in the wellbore, to provide two independent fluid pathways, one for the injection of a power fluid, and a second for the production of reservoir fluids mixed with said power fluid;

(b) providing said well with a jet pump, said jet pump being installed downhole within the inner tubing string for the purpose of lifting the fluids to the surface through the annulus between the concentric tubing strings;

(c) providing said well with an annular seal between a casing and the outer tubing installed in said wellbore above a productive interval of said subterranean reservoir;

(d) injecting said power fluid through the inner tubing string into said wellbore; and (e) driving said jet pump with said power fluid, said power fluid being injected from the surface entering said jet pump from the inner tubing, said jet pump driven by said injected power fluid lifting said produced fluids containing hydrogen sulphide and sulphur from said reservoir to the surface through the annulus between the concentric tubing strings, said method being characterized in that pressurizing action of said jet pump driven by said injected power fluid in the presence of hydrogen sulphide operates to retain sulphur in a physically dissolved, chemically bound, or other non-plugging state within the admixed fluids, said admixture of fluids having enhanced sulphur dissolving capacity, and in that a liquid film is formed on the surfaces of said annulus between the concentric tubing strings, said liquid film impeding deposition of sulphur upon said surfaces of said annulus, whereby sulphur deposition and/or plugging within said annulus between said concentric tubing strings is substantially prevented.

The present invention additionally provides a method for the production of fluids containing hydrogen sulphide and sulphur, said fluids being prone to sulphur deposition or production problems due to high viscosity thereof, from a subterranean reservoir containing said fluids, via a well penetrating said reservoir, said method of production comprising:

(a) providing said well with two parallel tubing strings in the wellbore, to provide two independent fluid pathways, one for the production of reservoir fluids mixed with power fluid and another one for the injection of said power fluid;

(b) providing said well with a jet pump downhole in a first one of said parallel inner tubing strings, this first tubing string being open below said jet pump for the entry of reservoir fluid, and continuing to the surface;

(c) extending the second tubing string from the surface and connecting it to the first tubing string at the level of said jet pump;

(d) extending said first tubing string below the connection with said second tubing string to an annular seal between a casing and the connected tubing, installed in said wellbore above a productive interval of said subterranean reservoir (e) injecting said power fluid into said well via one of said two parallel tubing strings; and (f) driving said jet pump with said injected power fluid, said power fluid entering said jet pump from said one of said two parallel tubing strings, said jet pump driven by said injected power fluid lifting said produced fluids containing hydrogen sulphide sulphur from said reservoir to the surface via the first-mentioned of said parallel tubing strings, said method being characterized in that pressurizing action of said jet pump driven by said injected power fluid in the presence of hydrogen sulphide operates to retain sulphur in a physically dissolved, chemically bound, or other non-plugging sate within the admixed fluids, said admixture of fluids having enhanced sulphur dissolving capacity, and in that a liquid film is formed on the inner surface of the first-mentioned of said parallel tubing strings, said liquid film impeding deposition of sulphur upon said inner surface of said first-mentioned tubing string conveying produced fluids to the surface, whereby sulphur deposition and/or plugging within said first-mentioned tubing string is substantially prevented.

The present invention also broadly provides, in accordance with another aspect thereof, a jet pump assembly for the production of fluids containing hydrogen sulphide and sulphur, said fluids being prone to sulphur deposition or production problems due to the high viscosity thereof, from a subterranean reservoir containing said fluids, via a well penetrating said reservoir, comprising:

(a) means installed within the wellbore of said well for providing two independent fluid pathways, one being for the injection of a power fluid, and a second being for the production of reservoir fluids mixed with said power fluid; and (b) a jet pump installed downhole within the wellbore of said well, operatively connected with said means for providing two independent fluid pathways, said jet pump being driven by power fluid injected thereinto through said one fluid pathway, and being operative to lift said produced fluids containing hydrogen sulphide and sulphur and mixed with said injected power fluid from said reservoir to the surface through said second-mentioned means for providing independent fluid pathways, and being further operative in the presence of injected power fluid and of hydrogen sulphide to retain sulphur in a physically dissolved, chemically bound or other non-plugging state within the admixture of power fluid and reservoir fluids in said wellbore, and thereby substantially preventing sulphur deposition from said fluids within said second-mentioned means for providing independent fluid pathways within said wellbore.

DETAILED DESCRIPTION OF THE INVENTION

FIG. 1 is an undimensioned pressure and temperature graph showing various pressure-temperature paths for hydrogen sulphide fluids being produced from a subterranean reservoir to the surface. An example phase envelope for a typical hydrogen sulphide reservoir fluid is also shown in relation to possible pressure and temperature conditions at the wellhead for a corresponding method of production. The phase envelope of the two phase region is defined by the bubble point curve and the dew-point curve. As indicated on the figure, the natural flow (path a) from the initial reservoir conditions to the wellhead conditions falls within the two phase region, suggesting that sulphur deposition could be a problem. Through the use of jet pumping (path b) or heating (path c) the pressure-temperature pathway of the produced fluids remains outside the two phase region. Although both cases are improvements over the natural flow situation, jet pumping still results in a temperature loss while heating experiences a pressure loss. The combined case (path b), however, employs the advantages of both jet pumping and heating to obtain wellhead conditions with less susceptibility to sulphur deposition.

Figure 2:
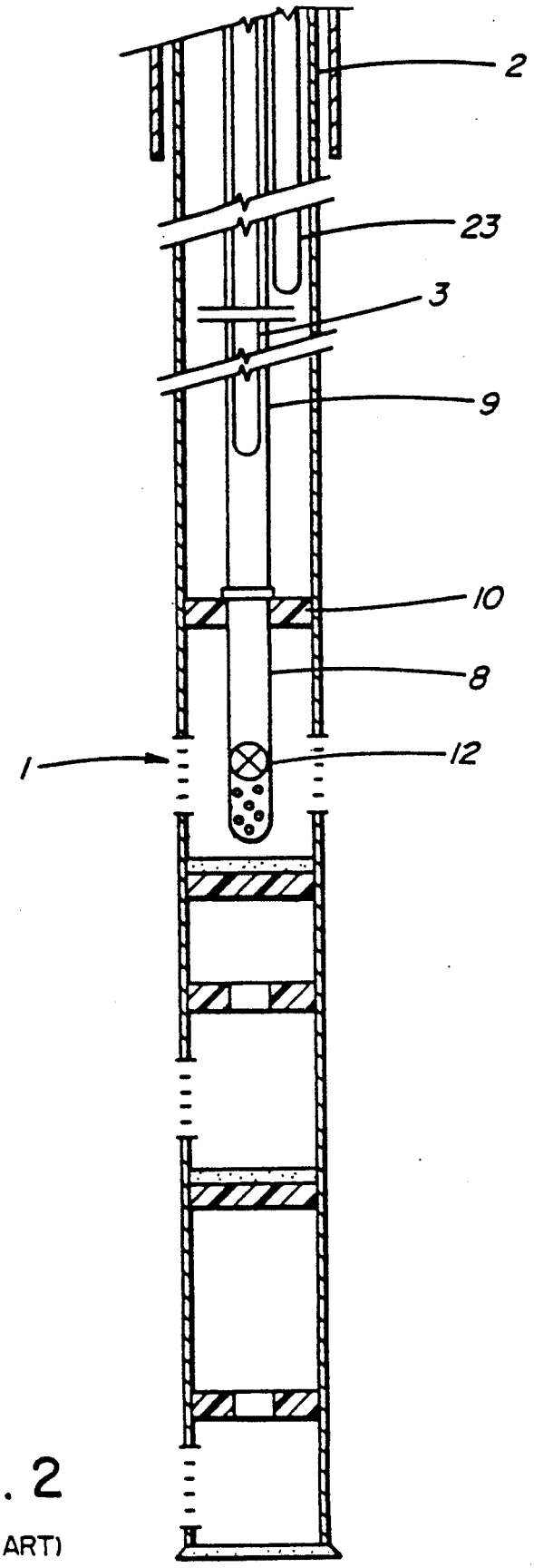
FIG. 2 (PRIOR ART)
FIG. 2 is a schematic representation of a well equipped in the manner of the prior art.

FIG. 2 shows a well equipped in the manner of the prior art. The well casing 2 is perforated in the productive interval 1. An outer tubing 9 is installed within the well casing 2. A tail pipe section 8 extends from the casing annular seal 10 to the productive interval. The outer tubing 9 and the tail pipe 8 are typically a continuous string. The casing annular seal 10 serves to block the flow of reservoir fluids of the productive interval 1 from the annular space between the outer tubing 9 and the well casing 2 and to force the fluids to enter the tail pipe 8. A production tubing 3 is installed concentrically within the outer tubing 9 to provide an annular pathway between the two tubing strings. The annular pathway is typically used for circulating sulphur solvents, corrosion inhibitors or hydrate temperature depressants down the well and to provide a means to commingle them with produced fluids A heater string 23 is installed in the annulus between the outer tubing 9 and the well casing 2 to allow the circulation of heated fluids into the well.

Figure 3:
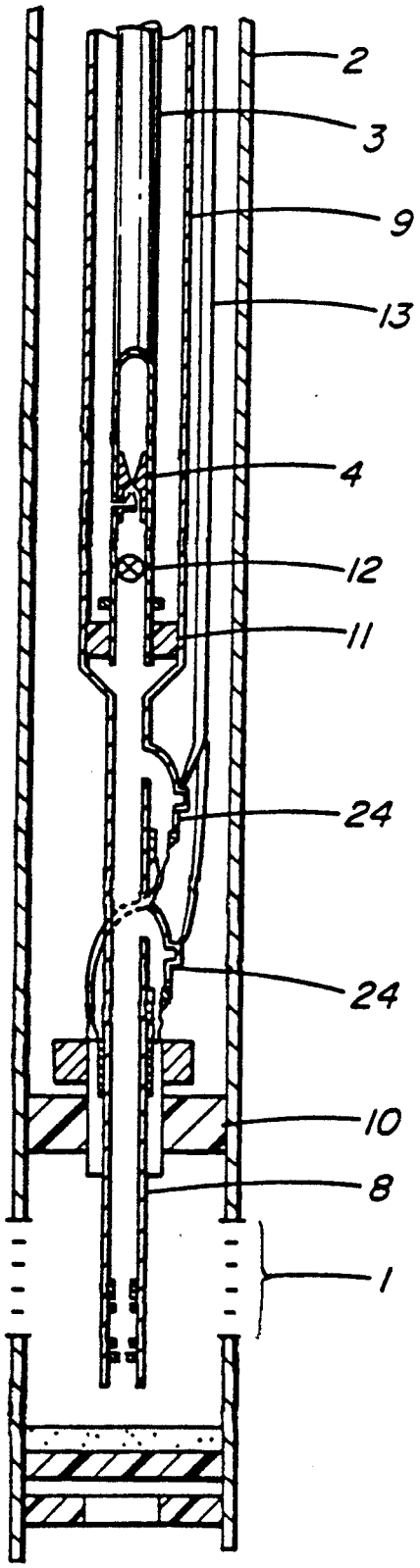
FIG. 3 shows the downhole tubing string configuration as tested by the inventors at TGS Panther River 5-23-30-11 W5M.

FIG. 3 shows the downhole tubing string configuration tested by the inventors at TGS Panther River 5-23-30-11 W5M. The well casing 2 is perforated in the productive interval 1. An outer tubing 9 is installed within the well casing 2. A tail pipe section 8 extends from the casing annular seal 10 to the productive interval. The outer tubing 9 and the tail pipe 8 are a continuous string. The casing annular seal 10 serves to block the flow of reservoir fluids of the production interval 1 from the annular space between the outer tubing 9 and the well casing 2. An encapsulated chemical injection tubing 13 is attached to the outside of the outer tubing 9. The injection tubing lines within the encapsulated chemical injection tubing are connected to side pocket chemical injection mandrels 24 which are made up at the bottom of the outer tubing 9. The side pocket chemical injection mandrels 24 hold chemical injection valves which limit the amount of fluids that is injected down the chemical injection tubing lines that is passed onto the casing annular seal 10. The casing annular seal 10 is equipped with passageways which transmit fluid from the chemical injection tubing lines to the annular space between the tail pipe 8 and the well casing 2. A production tubing 3 is concentrically installed within the outer tubing 9. Annular seal 10 is installed between the outer tubing 9 and the production tubing 3 to segregate the power fluid injected at high pressure down the annulus between the production tubing 3 and the outer tubing 9 from the fluids produced from the productive interval 1. A tubing check valve 12 is installed in the production tubing 3 to prevent any fluids either within the production tubing 3 or in the annulus between the production tubing 3 and the outer tubing 9 from flowing downwardly towards the productive interval 1. A jet pump 4 is installed within the production tubing 3. Heated power fluid injected at high pressure down the annulus between the production tubing 3 and the outer tubing 9 and fluid from the productive interval 1 enter the jet pump 4 and exit it to flow to the surface up the production tubing 3.

Figure 4A:
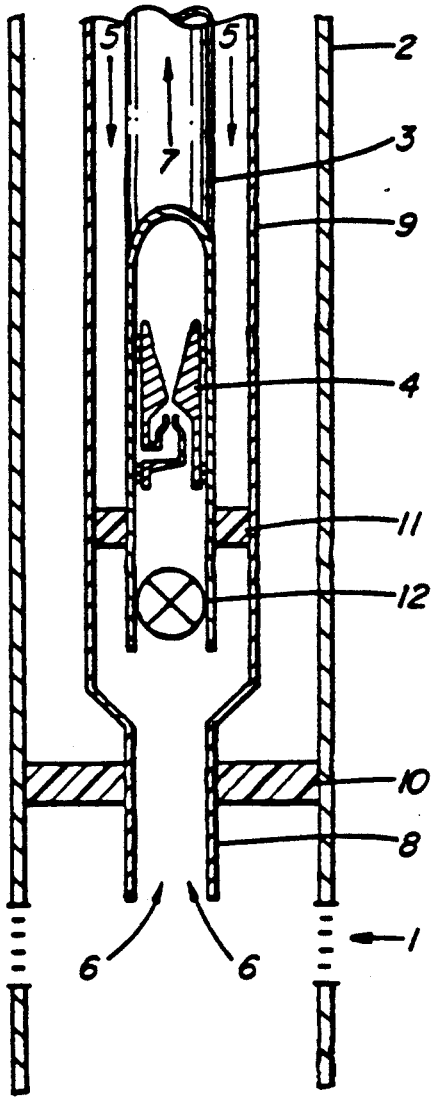
FIG. 4A shows a downhole tubing string configuration featuring concentric tubing and a reverse flow jet pump.

FIG. 4A shows a downhole configuration featuring a concentric tubing configuration and a reverse flow jet pump. The well casing 2 is perforated in the productive interval 1. The outer tubing 9 is installed within the well casing 2. A tail pipe section 8 extends from the casing annular seal 10 to the productive interval 1. The outer tubing 9 and the tail pipe 8 are typically a continuous string. The casing annular seal 10 serves to block the reservoir fluids 6 from the annular space between the outer tubing 9 and the well casing 2. A production tubing 3 is concentrically installed within the outer tubing 9. The annular seal 11 is installed between the outer tubing 9 and the production tubing 3 to segregate the power fluid injected at high pressure down the annulus 5 between the production tubing 3 and the outer tubing 9 from the reservoir fluids 6. A tubing check valve 12 is installed in the production tubing 3 to prevent any fluids either within the production tubing 3 or in the annulus pathway 5 from flowing downwardly towards the productive interval 1. A jet pump 4 is installed within the production tubing 3. Power fluid injected at high pressure down the annular pathway 5 and reservoir fluid 6 enter the jet pump 4 and exit it to flow to the surface up the production tubing 3.

Figure 4B:
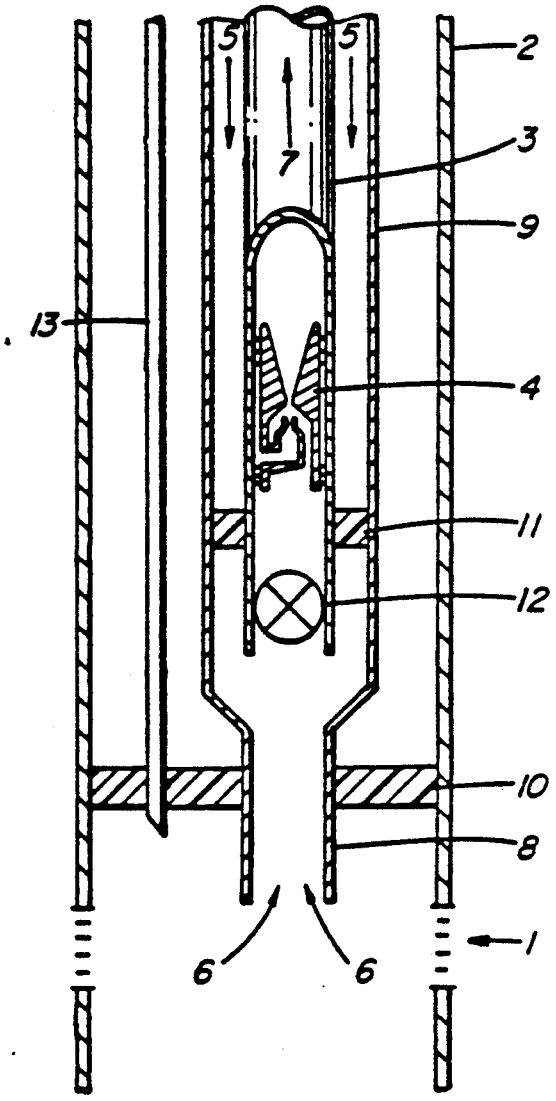
FIG. 4B shows a downhole tubing string configuration featuring concentric tubing and a reverse flow jet pump with chemical injection.

FIG. 4B shows a downhole configuration featuring concentric tubing and a reverse flow jet pump with chemical injection. The well casing 2 is perforated in the productive interval 1. The outer tubing 9 is installed within the well casing 2. A tail pipe section 8 extends from the annular seal 10 to the productive interval 1. The outer tubing 9 and the tail pipe 8 are typically a continuous string. The casing annular seal 10 serves to block the reservoir fluids 6 from the annular space between the outer tubing 9 and the well casing 2. A production tubing 3 is concentrically installed within the outer tubing 9. The annular seal 11 is installed between the outer tubing 9 and the production tubing 3 to segregate the power fluid injected at high pressure down the annulus 5 between the production tubing 3 and the outer tubing 9 from the reservoir fluids 6. A tubing check valve 12 is installed in the production tubing 3 to prevent any fluids either within the production tubing 3 or in the annular pathway 5 from flowing downwardly towards the productive interval 1. A jet pump 4 s installed within the production tubing 3. Power fluid injected at high pressure down the annular pathway 5 and reservoir fluid 6 enter the jet pump 4 and exit it to flow to the surface up the production tubing 3. A separate chemical injection tubing 13 (either an encapsulated type or a macaroni type) is installed in the annulus between the outer tubing 9 and the well casing 2. The chemical injection tubing 13 passes through the casing annular seal 10 such that fluids injected down the chemical injection tubing 13 commingle with the reservoir fluids 6 before they enter the tail pipe 8 and are produced to the surface.

Figure 4C:
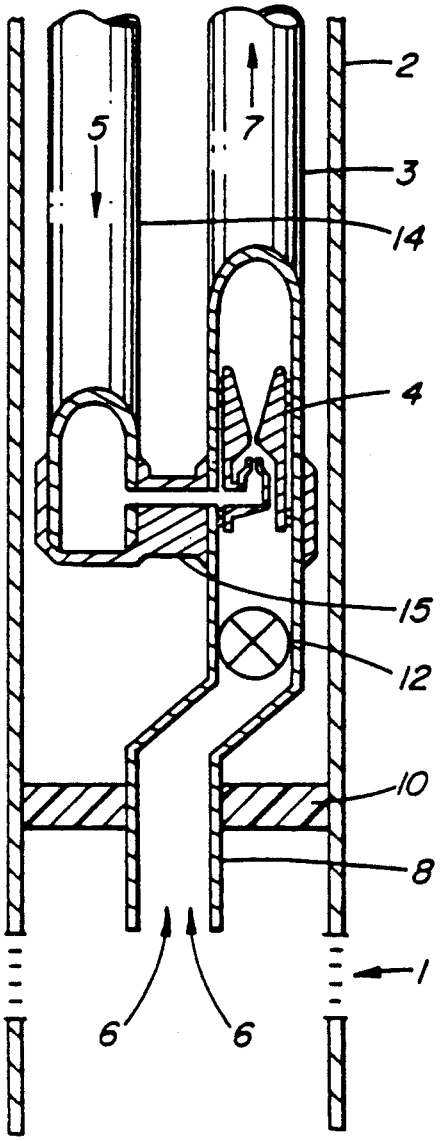
FIG. 4C shows a downhole tubing string configuration featuring parallel tubing with a jet pump.

FIG. 4C shows a downhole configuration featuring parallel tubing with a jet pump. The well casing 2 is perforated in the productive interval 1. The production tubing 3 is installed within the well casing 2 and parallel to the power fluid injection tubing 14. A tail pipe section 8 extends from the casing annular seal 10 to the productive interval 1. The production tubing 3 and the tail pipe 8 are typically a continuous string. The casing annular seal 10 serves to block the reservoir fluids 6 from the space above the annular seal 10 which contains the parallel tubing strings. The power fluid injection tubing 14 is connected to the production tubing 3 by a power fluid cross-over device 15 which permits the power fluid injected at high pressure down the tubing 14 to enter the jet pump 4 which is located in the production tubing 3. Reservoir fluids 6 also enter the jet pump 4. All fluids exit from the jet pump 4 and flow to the surface up the production tubing 3. A tubing check valve 12 is installed in the production tubing 3 to prevent any fluids either in the production tubing 3 or in the power fluid injection tubing 14 from flowing downwardly towards the productive interval 1.

Figure 4D:
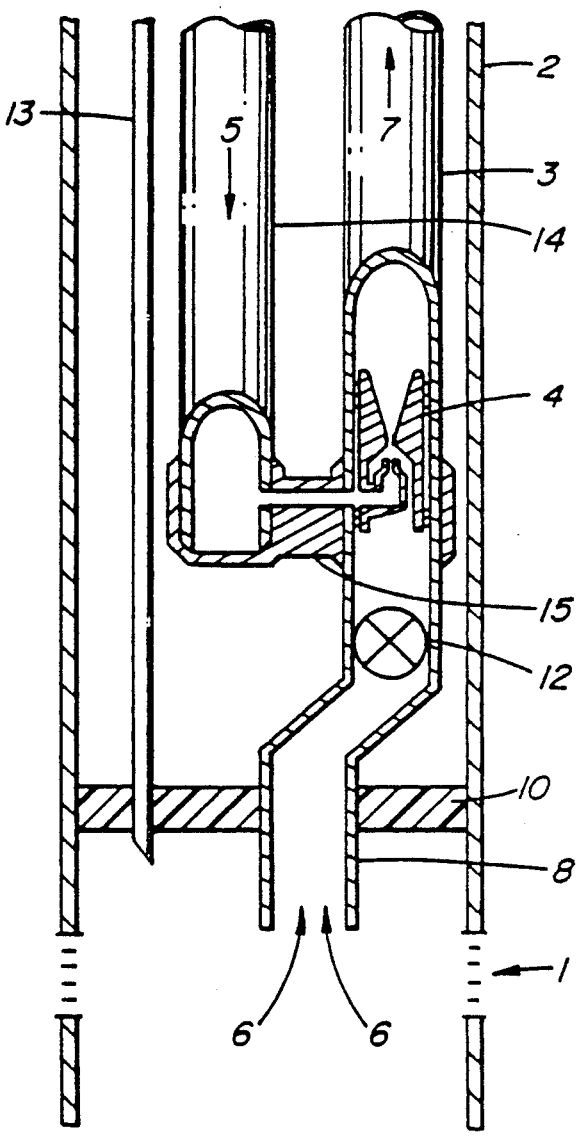
FIG. 4D shows a downhole tubing string configuration featuring parallel tubing with a jet pump and chemical injection.

FIG. 4D shows a downhole configuration featuring parallel tubing with a jet pump and chemical injection tubing. The well casing 2 is perforated in the productive interval 1. The production tubing 3 is installed within the well casing 2 and parallel to the power fluid injection tubing 14. A tail pipe section 8 extends from the casing annular seal 10 to the productive interval 1. The production tubing 3 and the tail pipe 8 are typically a continuous string. The casing annular seal 10 serves to block the reservoir fluids 6 from the space above the annular seal 10 which contains the parallel tubing strings. The power fluid injection tubing 14 is connected to the production tubing 3 by a power fluid cross-over device 15 which permits the power fluid injected at high pressure down the tubing 14 to enter the jet pump 4 which is located in the production tubing 3. Reservoir fluids 6 also enter the jet pump 4. All fluids exit the jet pump 4 and flow to the surface up the production tubing 3. A tubing check valve 12 is installed in the production tubing 3 to prevent any fluids either in the production tubing 3 or in the power fluid injection tubing 14 from flowing downwardly towards the productive interval 1.

A separate chemical injection tubing 13 (either encapsulated type or a macaroni type) is installed within the well casing 2 and parallel to the production tubing 3 and the power fluid injection tubing 14. The chemical injection tubing 13 passes through the casing annular seal 10 such that fluids injected down the chemical injection tubing 13 commingle with the reservoir fluids 6 before they enter the tail pipe 8 and are produced to the surface.

Figure 4E:
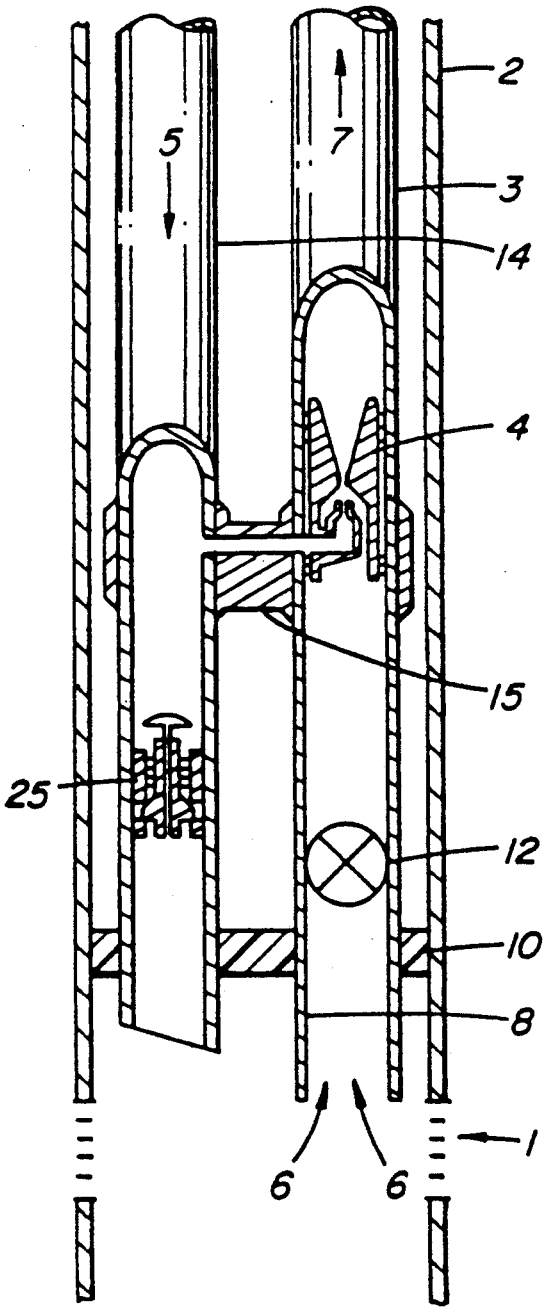
FIG. 4E shows a downhole tubing string configuration featuring parallel tubing with a jet pump and power fluid bypass injector.

FIG. 4E shows a downhole configuration featuring parallel tubing with a jet pump and a power fluid bypass injector. The well casing 2 is perforated in the productive interval 1. The production tubing 3 is installed within the well casing 2 and parallel to the power fluid injection tubing 14. A tail pipe section 8 extends from the casing annular seal 10 to the productive interval 1. The production tubing 3 and the tail pipe 8 are typically a continuous string. The casing annular seal 10 serves to block the reservoir fluids 6 from entering the space above the annular seal 10 which contains the parallel tubing strings. The power fluid injection tubing 14 is connected to the production tubing 3 by a power fluid cross-over device 15 which permits the power fluid injected at high pressure down the tubing 14 to enter the jet pump 4 which is located in the production tubing 3. The power fluid injection tubing 14 extends below the power fluid cross-over device 15 and penetrates the casing annular seal 10 such that the interior of the power fluid injection tubing 14 is in direct communication with the space below the casing annular seal 10. A removable power fluid bypass injector 25 is positioned in the power fluid injection tubing 14 below the power fluid cross-over device 15. The power fluid bypass injector 25 allows a portion of the power fluid injected at high pressure down the power fluid injection tubing 14 to pass directly to the space below the casing annular seal 10. In this way power fluid and chemicals in the power fluid can commingle with reservoir fluids 6 before they enter the jet pump. Fluids from below the annular seal 10 enter the jet pump 4. All fluids exit from the jet pump 4 and flow to the surface up the production tubing 3. A tubing check valve 12 is installed in the production tubing 3 to prevent downward flow of fluids through the tail pipe 8.

Figure 4F:
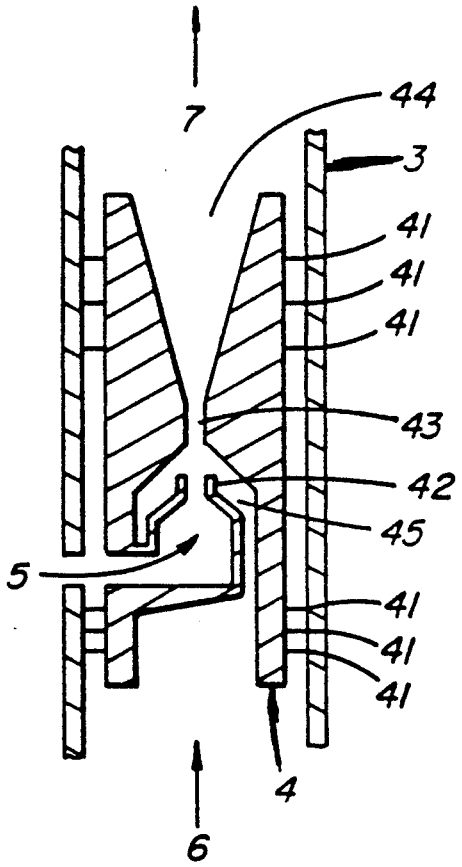
FIG. 4F is a schematic of a jet pump section.

FIG. 4F is a schematic of a jet pump section. A power fluid 5 is pumped down through an independent pathway and through a nozzle assembly 42 within the jet pump. After passing through the nozzle, the power fluid enters a mixing chamber 45 at high velocity and reduced pressure such that it entrains the produced fluids 6 containing hydrogen sulphide. Afterwards, the commingled fluids pass through the throat 43 and then enter the diffuser 44 where the velocity of the fluids decreases and the pressure increases to a value above that which occurs in the mixing chamber and the productive interval. This pressure is sufficient to expel the commingled fluids 7 from the jet pump and cause them to flow to the surface through the production tubing 3. The annular seals 41 prevent any fluid from passing along the sides of the jet pump.

Figure 5:
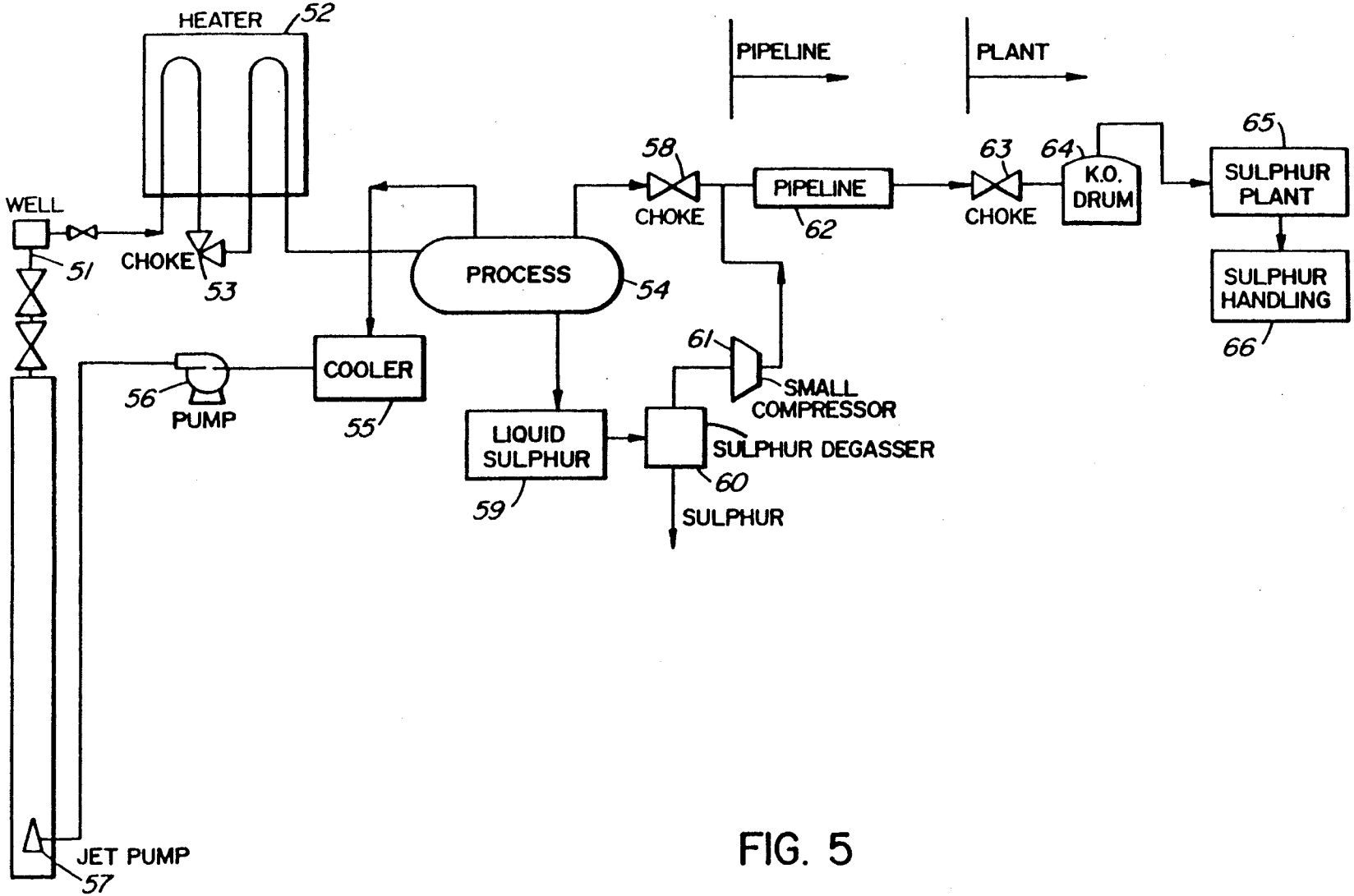
FIG. 5 is a schematic illustration of a process for the recycling of a hydrogen sulphide rich reservoir fluid.

FIG. 5 shows a process schematic for the recycling of a hydrogen sulphide rich reservoir fluid where the desulphurated hydrogen sulphide component of the reservoir fluid is to be reinjected downhole to be used as a sulphur solvent and also to be used to drive the jet pump. Produced fluids leave the wellhead 51 and pass to a choke bath heater 52 where the fluids are warmed, depressurized at the choke 53 and warmed again. The fluids flow from the choke bath heater 52 to a process vessel 54. A portion of hydrogen sulphide rich gas in the process vessel 54 passes on to a cooler 55 where the gas is condensed to a liquid state and injected into the well with pump 56 to drive the jet pump 57. The condensed hydrogen sulphide rich gas acts as a power fluid and as a sulphur solvent. The condensed hydrogen sulphide rich gas mixes with new produced fluids and all fluids are produced to the wellhead.

As a result of the operating temperature and pressure within the process vessel 54, some liquid sulphur is formed and exits the process vessel 54 to a sulphur degasser 60. Gases are drawn from the sulphur degasser 60 by a compressor 61 which injects the gas into the pipeline 62.

The majority of the gas produced from the well exits the process vessel 54, passes through a choke 58, and enters the pipeline 62. The gas in the pipeline 62 flows to a plant where the pressure is controlled by a choke 63 and a knock out drum 64 is used to catch any liquids which may condense from the gas. The gases are passed on to a sulphur plant 65 where elemental sulphur is recovered and sent for sulphur handling 66.

Figure 6A:
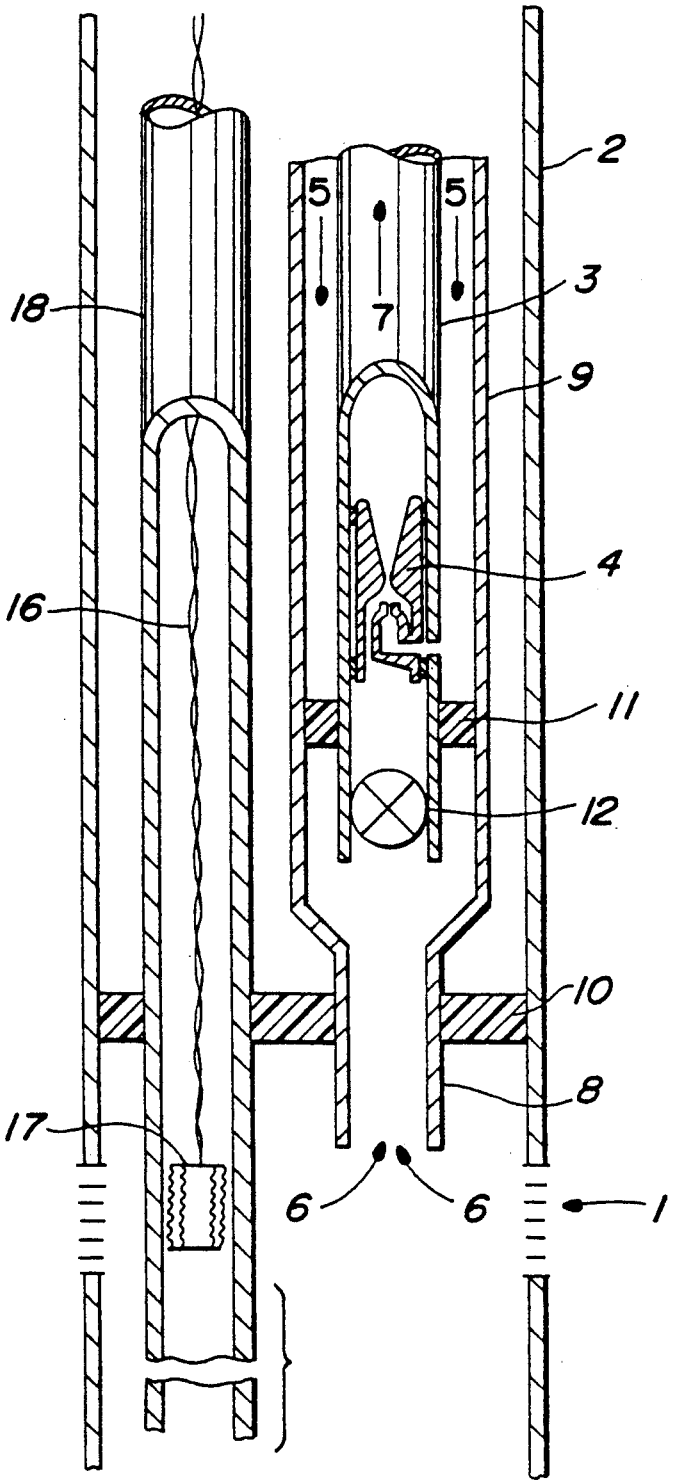
FIG. 6A shows a reverse flow downhole tubing string configuration with a jet pump, to which an auxiliary tubing string with a cable-powered electrical heater has been added.

FIG. 6A shows a reverse flow jet pumping configuration to which an auxiliary tubing string with a cable powered electrical heater has been added. The well casing 2 is perforated in the productive interval 1. The outer tubing 9 is installed within the well casing 2. A tail pipe section 8 extends from the casing annular seal 10 to the productive interval 1. The outer tubing 9 and the tail pipe 8 are typically a continuous string. The casing annular seal 10 serves to block the reservoir fluids 6 from the annular space between the outer tubing 9 and the well casing 2. A production tubing 3 is concentrically installed within the outer tubing 9. The annular seal 11 is installed between the outer tubing 9 and the production tubing 3 to segregate the power fluid injected at high pressure down the annulus 5 between the production tubing 3 and the outer tubing 9 from the reservoir fluids 6. A tubing check valve 12 is installed in the production tubing 3 to prevent any fluids either within the production tubing 3 or in the annulus pathway 5 from flowing downwardly towards the productive interval 1. A jet pump 4 is installed within the production tubing 3. Power fluid injected at high pressure down the annular pathway 5 and reservoir fluid 6 enter the jet pump 4 and exit it to flow to surface up the production tubing 3.

An auxiliary tubing 18 is installed within the well casing 2, being parallel with the concentric tubing strings 3 and 9. The auxiliary tubing 18 extends through the annular seal 10 towards the productive interval 1 A cable powered downhole electrical heater 17 is positioned within the auxiliary tubing 18 near the productive interval 1 and below the bottom of the tail pipe section 8 in order to heat the reservoir fluids 6 before they reach the jet pump 4. The cable powered downhole electrical heater 17 is powered by power cable 16 which also serves to run and retrieve the cable powered downhole electrical heater 17.

Figure 6B:
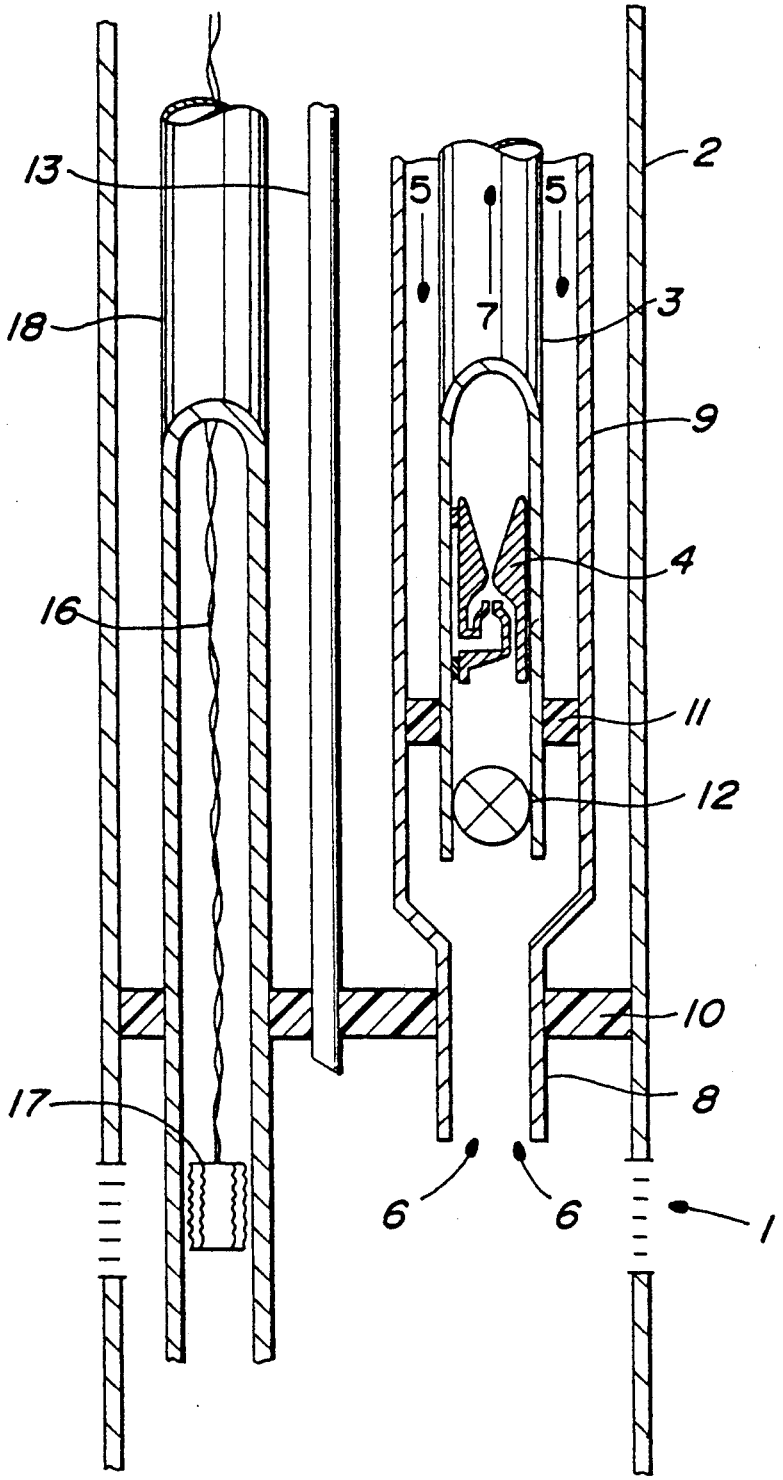
FIG. 6B shows a reverse flow downhole tubing string configuration with a jet pump, to which chemical injection tubing and an auxiliary tubing string with a cable-powered electrical heater have been added.

FIG. 6B shows a reverse flow jet pumping configuration to which chemical injection tubing and an auxiliary tubing string with a cable powered electrical heater have been added. The well casing 2 is perforated in the productive interval 1. The outer tubing 9 is installed within the well casing 2. A tail pipe section 8 extends from the annular seal 10 to the productive interval 1. The outer tubing 9 and the tail pipe 8 are typically a continuous string. The casing annular seal 10 serves to block the reservoir fluids 6 from the annular space between the outer tubing 9 and the well casing 2. A production tubing 3 is concentrically installed within the outer tubing 9. Annular seal 11 is installed between the outer tubing 9 and the production tubing 3 to segregate the power fluid injected at high pressure down the annulus 5 between the production tubing 3 and the outer tubing 9 from the reservoir fluids 6. A tubing check valve 12 is installed in the production tubing 3 to prevent any fluids either within the production tubing 3 or in the annular pathway 5 from flowing downwardly towards the productive interval 1. A jet pump 4 is installed within the production tubing 3. Power fluid injected at high pressure down the annular pathway 5 and reservoir fluid 6 enter the jet pump 4 and exit it to flow to the surface up the production tubing 3. A separate chemical injection tubing 13 (either an encapsulated type or a macaroni type) is installed in the annulus between the outer tubing 9 and the well casing 2. The chemical injection tubing 13 passes through the casing annular seal 10 such that fluids injected down the chemical injection tubing 13 commingle with the reservoir fluids 6 before they enter the tail pipe 8 and are produced to the surface. An auxiliary tubing 18 is installed within the well casing 2 and parallel to the chemical injection tubing 13 as well as the concentrically configured tubing strings 3 and 9. The auxiliary tubing 18 extends through the annular seal 10 towards the productive interval 1. A cable powered downhole electrical heater 17 is positioned within the auxiliary tubing 18 near the productive interval 1 and below the bottom of the tailpipe section 8 in order to heat the reservoir fluids 6 before they reach the jet pump 4. The cable powered downhole electrical heater 17 is powered by power cable 16 which serves to run the cable powered downhole electrical heater 17 into place and also to retrieve it.

Figure 7A:
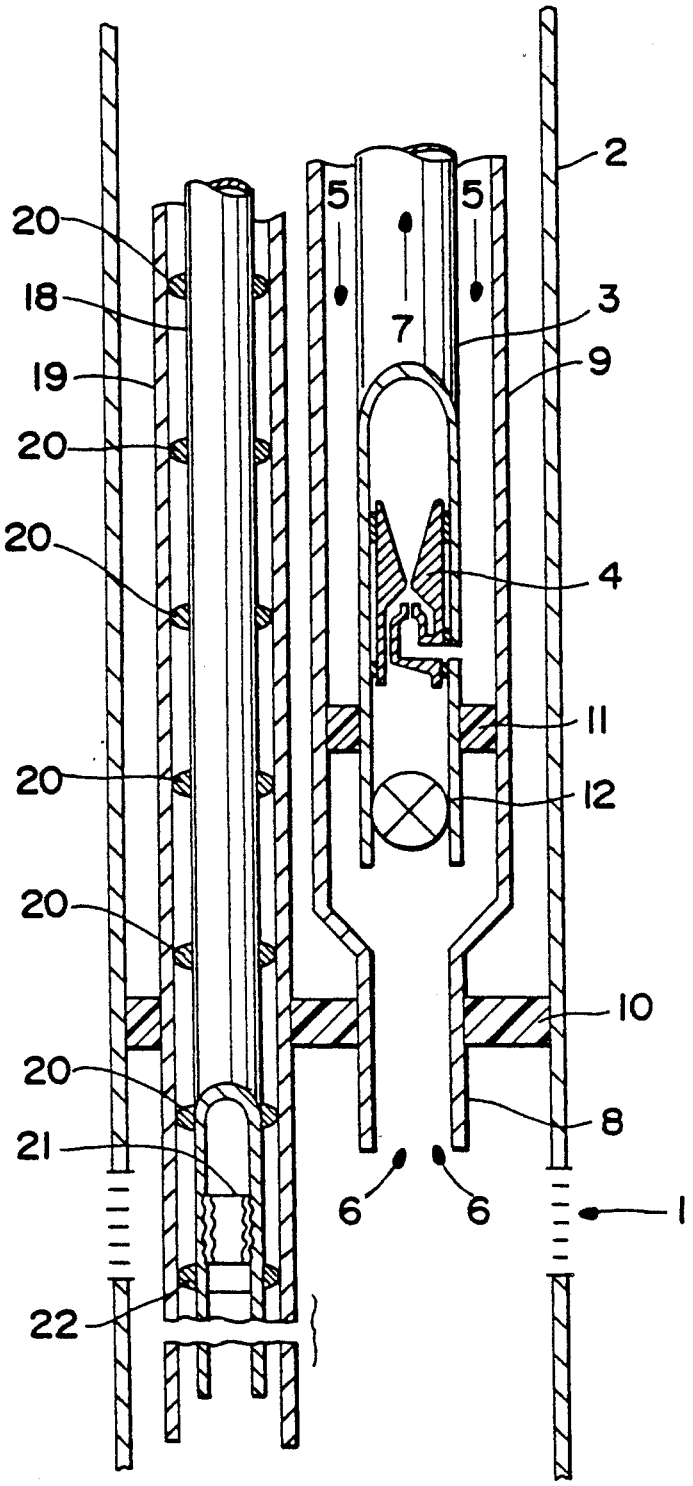
FIG. 7A shows a reverse flow downhole tubing string configuration with a jet pump, to which a dual concentric auxiliary tubing string with a downhole heater has been added.

FIG. 7A shows a reverse flow jet pumping configuration to which a dual concentric auxiliary tubing string with a downhole heater has been added. The well casing 2 is perforated in the productive interval 1. The outer tubing 9 is installed within the well casing 2. A tail pipe section 8 extends from the casing annular seal 10 to the productive interval 1. The outer tubing 9 and the tail pipe 8 are typically a continuous string. The casing annular seal 10 serves to block the reservoir fluids 6 from the annular space between the outer tubing 9 and the well casing 2. A production tubing 3 is concentrically installed within the outer tubing 9. The annular seal 11 is installed between the outer tubing 9 and the production tubing 3 to segregate the power fluid injected at high pressure down the annulus 5 between the production tubing 3 and the outer tubing 9 from the reservoir fluids 6. A tubing check valve 12 is installed in the production tubing 3 to prevent any fluids either within the production tubing 3 or in the annulus pathway 5 from flowing downwardly towards the productive interval 1. A jet pump 4 is installed within the production tubing 3. Power fluid injected at high pressure down the annular pathway 5 and reservoir fluid 6 enter the jet pump 4 and exit it to flow to the surface up the production tubing 3. The outer auxiliary tubing 19 is installed within the well casing 2, and parallel to the concentric tubing strings 3 and 9. The outer auxiliary tubing 19 extends through the annular seal 10 towards the productive interval 1. An inner auxiliary tubing 18 is installed concentrically within the outer auxiliary tubing string 19. The two auxiliary tubing strings (18 & 19) are separated and electrically insulated from each other by electrically insulated centralizers 20. A flow through downhole electrical heater 21 is positioned within the inner auxiliary tubing string 18. The flow through downhole electrical heater 21 allows fluids injected down the inner auxiliary tubing string 18 to be heated before they mix with reservoir fluids 6. If no fluids are injected down the inner auxiliary tubing 18 then the flow through downhole electrical heater 21 serves to heat the reservoir fluids 6 before they enter the tailpipe section 8. The flow through downhole electrical heater 21 is powered by an electrical current along the concentric auxiliary tubing strings 18 and 19 which are electrically coupled at electrical contactor 22.

Figure 7B:
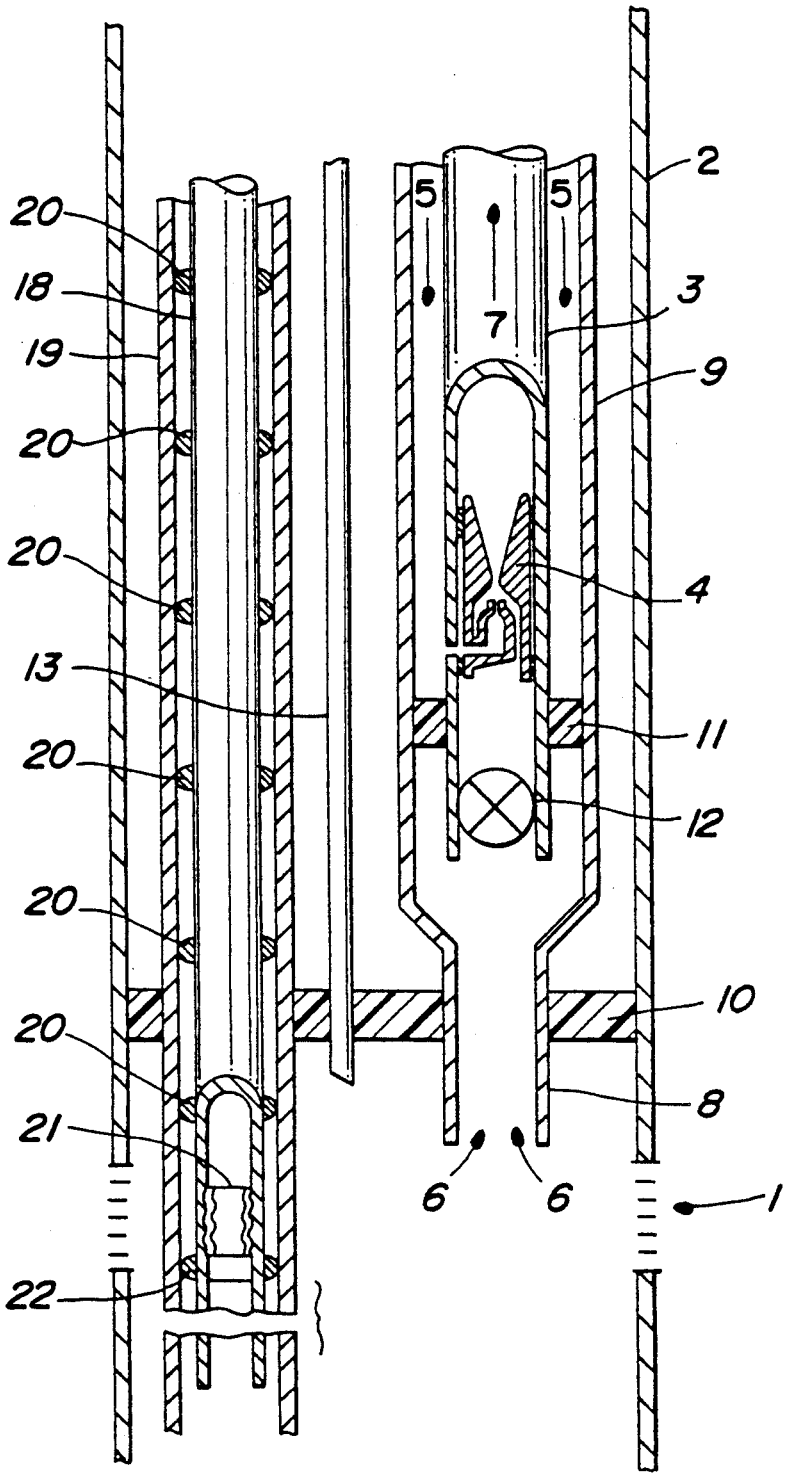
FIG. 7B shows a reverse flow downhole tubing string configuration with a jet pump, to which chemical injection tubing and dual concentric auxiliary tubing strings with a downhole heater have been added.

FIG. 7B shows a reverse flow jet pumping configuration to which a chemical injection tubing and dual concentric auxiliary tubing strings with a downhole heater have been added. The well casing 2 is perforated in the productive interval 1. The outer tubing 9 is installed within the well casing 2. A tail pipe section 8 extends from the annular seal 10 to the productive interval 1. The outer tubing 9 and the tail pipe 8 are typically a continuous string. The casing annular seal 10 serves to block the reservoir fluids 6 from the annular space between the outer tubing 9 and the well casing 2. A production tubing 3 is concentrically installed within the outer tubing 9. Annular seal 11 is installed between the outer tubing 9 and the production tubing 3 to segregate the power fluid injected at high pressure down the annulus between the production tubing 3 and the outer tubing 9 from the reservoir fluids 6. A tubing check valve 12 is installed in the production tubing 3 to prevent any fluids either within the production tubing 3 or in the annular pathway 5 from flowing downwardly towards the productive interval 1. A jet pump 4 is installed within the production tubing 3. Power fluid injected at high pressure down the annular pathway 5 and reservoir fluid 6 enter the jet pump 4 and exit it to flow to the surface up the production tubing 3. A separate chemical injection tubing 13 (either an encapsulated type or a macaroni type) is installed in the annulus between the outer tubing 9 and the well casing 2. The chemical injection tubing 13 passes through the casing annular seal 10 such that fluids injected down the chemical injection tubing 13 commingle with the reservoir fluids 6 before they enter the tail pipe 8 and are produced to the surface. The outer auxiliary tubing 19 is installed within the well casing 2 and parallel to the chemical injection tubing 13 as well as the concentrically configured tubing strings 3 and 9. The outer auxiliary tubing 19 extends through the annular seal 10 towards the productive interval 1 An inner auxiliary tubing 18 is installed concentrically within the outer auxiliary tubing string 19. The two auxiliary tubing strings 18 and 19 are separated and electrically insulated from each other by electrically insulated centralizers 20. A flow through downhole electrical heater is positioned within the inner auxiliary tubing string 18. The flow through downhole electrical heater 21 allows fluids injected down the inner auxiliary tubing string 18 to be heated before they mix with reservoir fluids 6. If fluids are not injected down the inner auxiliary tubing 18, then the flow through downhole electrical heater 21 serves to heat the reservoir fluids 6 before they enter the tailpipe section 8. The flow through downhole electrical heater 21 is powered by an electrical current along the concentric auxiliary tubing strings 18 and 19 which are electrically coupled at electrical contactor 22.

Figure 7C:
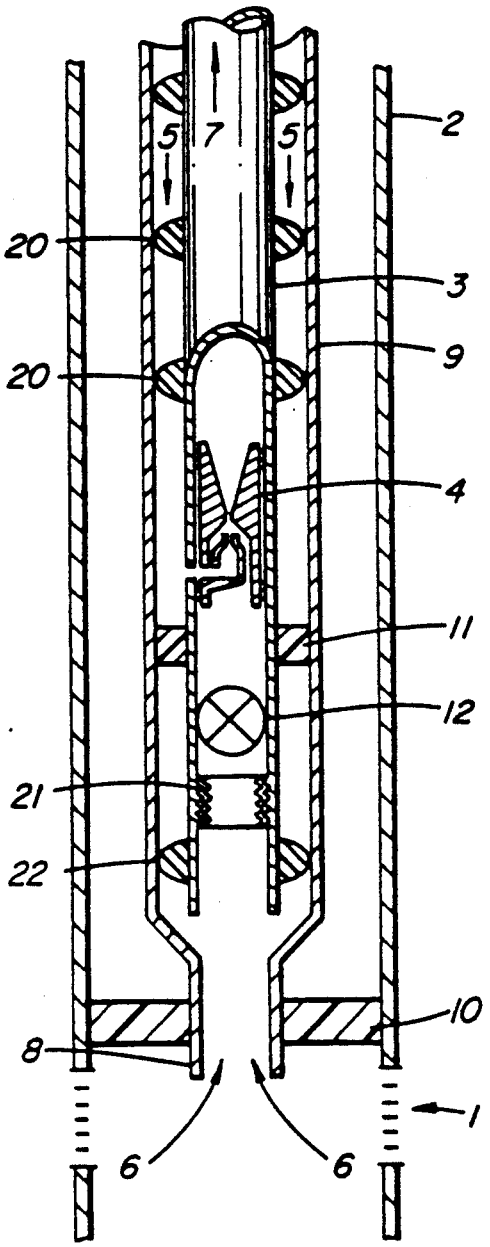
FIG. 7C shows a downhole tubing string configuration with a reverse flow jet pump which features a single concentric tubing configuration with downhole electrical heating.

FIG. 7C shows a downhole configuration featuring a single concentric tubing configuration with downhole electrical heating and a reverse flow jet pump. The well casing 2 is perforated in the productive interval 1. The outer tubing 9 is installed within the well casing 2. A tail pipe section 8 extends from the casing annular seal 10 to the productive interval 1. The outer tubing 9 and the tail pipe 8 are typically a continuous string. The casing annular seal 10 serves to block the reservoir fluids 6 from the annular space between the outer tubing 9 and the well casing 2. A production tubing 3 is concentrically installed within the outer tubing 9. The annular seal 11 is installed between the outer tubing 9 and the production tubing 3 to segregate the power fluid injected at high pressure down the annulus 5 between the production tubing and the outer tubing 9 from the reservoir fluids 6. A tubing check valve 12 is installed in the production tubing 3 to prevent any fluids either within the production tubing 3 or in the annular pathway 5 from flowing downwardly towards the productive interval 1. A jet pump 4 is installed within the production tubing 3. Power fluid injected at high pressure down the annular pathway 5 and reservoir fluid 6 enter the jet pump 4 and exit it to flow to surface up the production tubing 3. The outer tubing 9 is separated and electrically insulated from the production tubing 3 by electrically insulated centralizers 20. A flow through downhole electrical heater 21 is mounted in the production tubing string 3 below the jet pump 4, and usually below both the tubing check valve 12 and the annular seal 11. The flow through downhole electrical heater 21 is powered by an electrical current that runs along the two tubing strings 3 and 9 which are electrically coupled at electrical contactor 22. The electrical contactor 22 is positioned below the flow through downhole electrical heater 21.

Figure 7D:
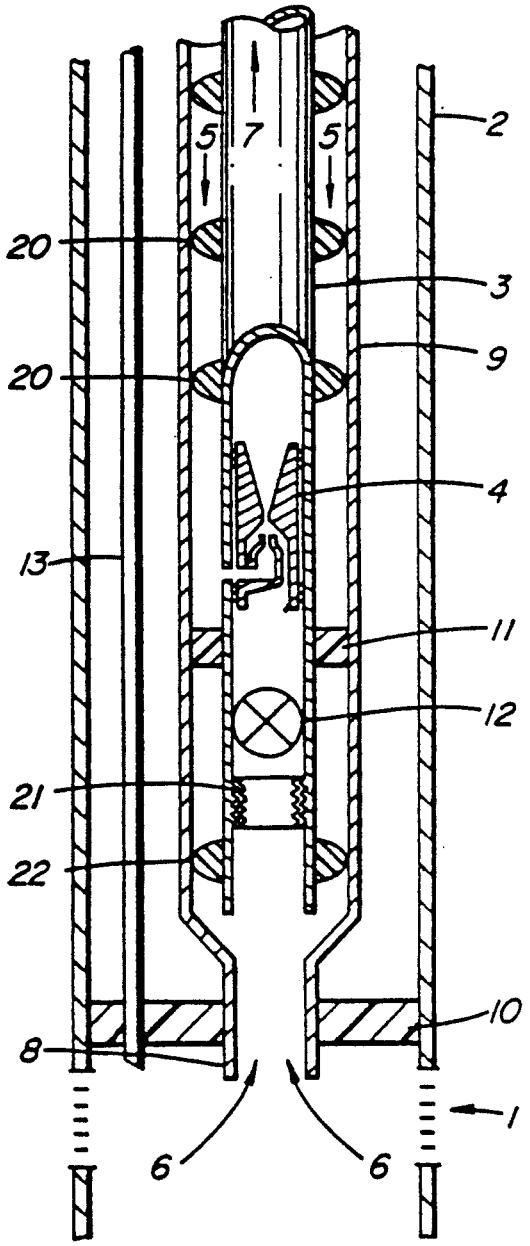
FIG. 7D shows a downhole tubing string configuration with a reverse flow jet pump which features a single concentric tubing configuration with downhole electrical heating and chemical injection tubing.

FIG. 7D shows a downhole configuration featuring a single concentric tubing configuration with downhole electrical heating a reverse flow jet pump and chemical injection tubing. The well casing 2 is perforated in the productive interval 1. The outer tubing 9 is installed within the well casing 2. A tail pipe section 8 extends from the annular seal 10 to the productive interval 1. The outer tubing 9 and the tail pipe 8 are typically a continuous string. The casing annular seal 10 serves to block the reservoir fluids 6 from the annular space between the outer tubing 9 and the well casing 2. A production tubing 3 is concentrically installed within the outer tubing 9. Annular seal 11 is installed between the outer tubing 9 and the production tubing 3 to segregate the power fluid injected at high pressure down the annulus 5 between the production tubing 3 and the outer tubing 9 from the reservoir fluids 6. A tubing check valve 12 is installed in the production tubing 3 to prevent any fluids either within the production tubing 3 or in the annular pathway 5 from flowing downwardly towards the productive interval 1. A jet pump 4 is installed within the production tubing 3. Power fluid injected at high pressure down the annular pathway 5 and reservoir fluid 6 enter the jet pump 4 and exit it to flow to the surface up the production tubing 3. A separate chemical injection tubing 13 (either an encapsulated type or a macaroni type) is installed in the annulus between the outer tubing 9 and the well casing 2. The chemical injection tubing 13 passes through the casing annular seal 10 such that fluids injected down the chemical injection tubing 13 commingle with the reservoir fluids 6 before they enter the tail pipe 8 and are produced to the surface. The outer tubing 9 is separated and electrically insulated from the production tubing 3 by electrically insulated centralizers 20. A flow-through downhole electrical heater 21 is mounted in the production tubing string 3 below the jet pump 4, and usually below both the tubing check valve 12 and the annular seal between concentric tubing 11. The flow-through downhole electrical heater 21 is powered by an electrical current that runs along the two tubing strings 3 and 9 which are electrically coupled at electrical contactor 22. The electrical contactor 22 is positioned near the flow-through downhole electrical heater 21.

Figure 7E:
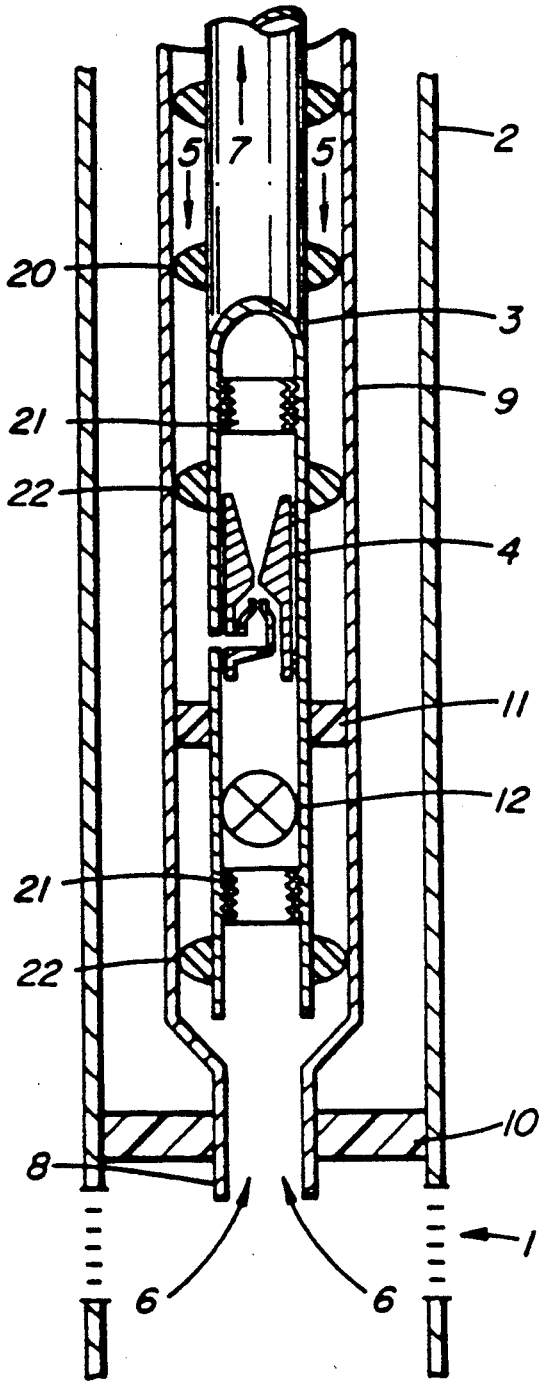
FIG. 7E shows a downhole tubing string configuration with a jet pump which features a single concentric tubing configuration with downhole electrical heaters placed above and below the jet pump.

FIG. 7E shows a downhole configuration featuring a single concentric tubing configuration with downhole electrical heaters paced above and below the jet pump. The well casing 2 is perforated in the productive interval 1. The outer tubing 9 is installed within the well casing 2. A tail pipe section 8 extends from the casing annular seal 10 to the productive interval 1. The outer tubing 9 and the tail pipe 8 are typically a continuous string. The casing annular seal 10 serves to block the reservoir fluids 6 from the annular space between the outer tubing 9 and the well casing 2. A production tubing 3 is concentrically installed within the outer tubing 9. The annular seal 11 is installed between the outer tubing 9 and the production tubing 3 to segregate the power fluid injected at high pressure down the annulus 5 between the production tubing 3 and the outer tubing 9 from the reservoir fluids 6. A tubing check valve 12 is installed in the production tubing 3 to prevent any fluids either within the production tubing 3 or in the annular pathway 5 from flowing downwardly towards the productive interval 1. A jet pump 4 is installed within the production tubing 3. Power fluid injected at high pressure down the annular pathway 5 and reservoir fluid 6 enter the jet pump 4 and exit it to flow to the surface up the production tubing 3. The outer tubing 9 is separated and electrically insulated from the production tubing 3 by electrically insulated centralizers 20. Flow-through down hole electrical heaters 21 are positioned within the production tubing 3. One flow-through downhole electrical heater 21 is placed above the jet pump 4. The second flow-through down hole electrical heater 21 is placed below the jet pump 4. Usually this second flow-through downhole electrical heater is placed below the annular seal between concentric tubing 11 and also below the tubing check valve 12. The flow-through downhole electrical heaters 21 are powered by an electrical current that runs along the two tubing strings 3 and 9 which are electrically connected at the two electrical contactors 22. One of the electrical contactors 22 is positioned between the flow-through downhole electrical heaters 21. The second electrical contactor 22 is positioned near the lower flow-through downhole electrical heater. The flow-through downhole electrical heaters 21 and the electrical contactors 22 are designed to obtain advantageous heating of the fluids rising in the production tubing 3 so as to minimize sulphur deposition.

In order to understand the role of temperature profile in the well-reservoir system, it is necessary to point out that, among the factors which are involved in the sulphur solubility phenomena higher temperatures increase the solubility of sulphur in the $H_2S$ fraction of produced fluid. It should also be mentioned that when the temperature of the fluid is above the melting point of sulphur, which varies with the fluid composition, sulphur deposition can occur in liquid form. A downhole heating process for hydrogen sulphide fluids which are prone to sulphur deposition problems and/or production problems due to high viscosity of the downhole well fluids could prevent formation of solid sulphur and reduce the viscosity of liquid sulphur within certain temperature ranges. Also, downhole heaters properly located in the wellbore could prevent hydrate formation. This system will allow for heating the reservoir zone adjacent to the wellbore with heaters known to people skilled in the art. The bottom hole heating could be combined with periods of injection, production, shut-in or pulsed shut-in, where short periods of injection or production interrupt the shut-in periods.

Data, background and support work for the invention, and its application, include the phase behaviour study undertaken for the above-mentioned fluids and other studies such as: sulphur solubility, sulphur solvents, hydrate formation, corrosion, tubing flow, artificial lift, casing, tubing, and optimization of surface processing equipment for the anticipated conditions including the influence of temperature, heating system optimization, core displacement, numerical simulation for reservoir performance, and pressure maintenance methods, as well as related topics which are normally considered in preparing an exploitation strategy for a reservoir of this type.

The main embodiment of the invention is based on the use of a jet pump system, field tested at the well 5-23-30-11 W5M Panther River, which permitted the production of the reservoir fluid containing 68% $H_2S$, and other components listed in page 4. As mentioned previously this well could not be produced continuously, when completed in the manner of the prior art.

The test performed included the demonstration of the practical application of a jet pump system (FIG. 3) comprised of:

- a concentric dual tubing configuration with 60.3 mm inner tubing 3 and a 101.6 mm outer tubing 9;
- a downhole packer assembly including a permanent packer with separate production and injection fluid pathways permitting continuous chemical injection through the packer; the packer tailpipe was arranged so as to allow injected chemicals to wash across the production zone 1 while commingling with the produced fluids;
- an encapsulated chemical injection tubing attached to the outer tubing string with two independent lines, one for chemical injection 13 (sulphur solvent, corrosion inhibitor, and hydrate temperature depressants) and the second one for bottom hole pressure monitoring, both lines were connected to a chemical injection head on the packer assembly permitting the function of each line to be interchanged;
- a jet pumping system comprised of a bottom hole jet pump actuated by a power fluid injected into the annular space between 60.3 mm and 101.6 mm tubing strings, and a surface installation for separation of the power fluid from the reservoir fluids and reinjection of the power fluid. A standing valve was incorporated below the jet pump to allow formation fluids to rise in the tubing and prevent downward flow of fluids. The reservoir fluids were drawn into the jet pump by the action of the power fluid and expelled from the jet pump at an increased pressure.
- the power fluid was heated to prevent hydrate formation and replace a heater string. Different power fluids were utilized such as: condensate DMDS (dimethyl disulphide) and a mixture of the two;
- corrosion monitoring devices in the form of two sets of corrosion coupons, one attached below the standing valve, plus another one installed at the surface and electronic sensors for corrosion detection. The corrosion coupons used were 20 mm×50 mm×5 mm samples of the tubing material mounted on coupon holders that could be removed from the well.
- a surface facility for separation and measurement of the various flow components.

Due to the remote location of the well, a subsurface safety valve (SSV) was not required; however, an SSSV, either a ball type or a flapper type, or any other suitable type could have been installed in the tubing: the decision to use an SSSV would be based on site specific safety concerns and regulatory requirements.

This jet pump system permitted the well to be produced continuously for 21 days as planned, including the clean-up period in which significant quantities of water were produced. The gas rates varied from 40 000 to 80 000 SCM/d with a peak sustainable production rate of 104 000 SCM/d depending on the well head pressure selected. Wellhead temperatures of 30° to 35° C. were maintained.

The use of a jet pump system is a unique technical solution applied for the first time for the production of sour gas with a high hydrogen sulphide concentration, carbon dioxide, methane and nitrogen, and prone to sulphur deposition phenomena.

The jet pumping system aids in limiting sulphur deposition in several ways The pressurizing action of the jet pump causes the sulphur loaded reservoir fluids to be at a higher pressure than natural flow when they are within the production tubing flowing to the surface and when they arrive at the wellhead Higher pressures promote the retention of sulphur in a non plugging form within the reservoir fluids. The pressurizing action of the jet pump also helps to maintain the reservoir fluids at pressures and temperatures outside of the phase envelope for the reservoir fluids. As a result flashing and cooling of the reservoir fluids is avoided or delayed and sulphur drop out from the reservoir fluids due to cooling is avoided.

The power fluid of a jet pumping system also adds a liquid phase to the reservoir fluid being produced to the surface when the two fluids are mixed at the jet pump. The liquid phase tends to collect at the walls of the production tubing. The presence of a liquid film on the walls of the tubing prevents any free elemental sulphur that may be released from the reservoir fluids, from attaching to and accumulating on the tubing walls to bridge and eventually form a sulphur plug. The power fluid typically also has the ability to carry some free sulphur. Heating the power fluid increases its sulphur carrying capacity. Heating of the power fluid also increases the temperature of the produced reservoir fluids which helps to maintain the sulphur within the reservoir fluids in a non plugging form.

The jet pump operates on a Venturi principle. The Venturi of the jet pump is made to work by injecting the power fluid through a nozzle and into a passageway for mixing with fluids produced from the formation. The power fluid flows at a high speed through the mixing passageway and causes a low pressure to exist which draws in produced fluids. The power fluid maintains a high velocity, as it flows through a throat, entraining the produced fluids, and commingling with them. The commingled fluids leave the throat at a high speed and enter a diffuser. The fluids slow down as they move through the diffuser and gain pressure according to Bernoulli's law.

The jet pump 4 used in the field test was the largest jet pump that could fit inside the selected tubing. The critical design factor for the viability of a jet pump for sour gas is the ratio of the nozzle area to the throat area. A nozzle to throat area ratio of 0.4 was used. Nozzle and throat combinations with a larger nozzle to throat area ratio of up to 0.517 can typically be used for high efficiency but the range of efficiency is narrow and restricts the operating range of the pump. Nozzle and throat combinations with a smaller nozzle to throat area ratio of as little as 0.144 can be used and will work in a wider range of operating conditions but the peak efficiency can be as low as 8%.

Economical jet pumping requires maximizing the throughput of reservoir fluids and minimizing the rate or pressure of power fluid injection. As a result of the field testing it has been concluded that higher throughput to reservoir fluids through the jet pump requires higher power fluid circulating rates. Higher power fluid circulating rates cause extreme pressure rises when the power fluid flows through the nozzle 42 (FIG. 4F) of the jet pump 4. Therefore, the nozzle of the jet pump should be as large as practical, keeping in mind that the diameter of the throat 43 and diffuser 44 must be increased so as to maintain the area ratio between the nozzle and the throat as discussed above. It will be found that the maximum size of the diffuser is limited by the size of the tubing which, in turn, will be limited by the size of casing 2 in the well or the size of equipment that must be installed in the casing.

A condensate oil as well as mixtures of oil and sulphur solvents were used as a power fluid during the field tests. The condensate oil worked adequately but was slightly compressible. Incompressible fluids work better as power fluids than compressible ones. High hydrogen sulphide content fluid is sufficiently incompressible if the fluid flows through the jet pump in a pressure and temperature regime outside of the two-phase envelope and above the cricondenbar (FIG. 1).

A variety of fluids and mixtures can be selected as power fluid for the jet pump. Some possible power fluids include water, mixed hydrocarbons, light oils, hydrocarbon condensate, alcohols, conditioned hydrogen sulphide reservoir fluids and specific sulphur solvents such as dimethyl disulphide (DMDS) or other dialkyl disulphides. Some of the fluids that can be added to a chosen power fluid include hydrate temperature depressants, corrosion inhibitors, surfactants, viscosity reducing agents, and specific sulphur solvents such as dimethyl disulphide (DMDS) or other dialkyl disulphides No matter what type of power fluid is chosen, it should be free of particles or deposits which would plug the injection pathway or the nozzle of the jet pump.

When selecting a power fluid, especially light oils, it is important to consider the sulphur carrying properties and the phase behaviour of the new fluid that results when the power fluid is commingled with the produced hydrogen sulphide reservoir fluids. The most suitable power fluids will have the ability to carry sulphur in solution or help to carry any deposited sulphur to the surface in a manner similar to a slurry. In some applications the power fluid can be chosen such that the phase separation of the mixed fluids, which occurs when pressure and temperature conditions enter the two phase region, forms a liquid fraction extra rich in hydrogen sulphide such that the sulphur carrying capacity greater than that of the power fluid and the hydrogen sulphide reservoir fluids prior to mixing. The phase behaviour of the mixed fluids is also important because: it affects the corrosion mechanisms that can be expected.

In a preferred embodiment of a jet pump application, formation fluid with a high $H_2S$ content would be conditioned at the surface to remove elemental sulphur and some light hydrocarbons. The conditioned formation fluid would then be recirculated downhole for use as a power fluid or a sulphur solvent. The use of water as a power fluid can be considered for specific applications if appropriate material selection and corrosion inhibitor programs are in place.

The advantage of this jet pump system, field tested by CEL, are the following:

- completion fluids including kill fluids heavy solvents loaded with dissolved sulphur and power fluids which exert a hydrostatic pressure in excess of the bottom hole flowing pressure, can be lifted from the well;
- the pressure and temperature of the produced fluids containing hydrogen sulphide in the tubing were increased and thus the sulphur carrying capacity of the reservoir fluids was increased thereby avoiding sulphur deposition and plugging in the tubing;
- by heating the power fluid, hydrate formation was eliminated and a heater string was not required;
- the use of an independent encapsulated chemical injection tubing permitted ideal dosage and placement of sulphur solvents and corrosion inhibitors across the perforations;
- the use of independent downhole pressure monitoring permitted continuous monitoring of the well during production testing;
- the strategic arrangement of the tailpipe at the bottom of the producing zone and the injection of the solvent/inhibitor mixture at the top of the producing zone, ensured that all perforations were washed properly and were open for production avoiding sulphur deposition in that zone;
- well control was effectively ensured by the hydrostatic column of the power fluid in the well and by the possibility of circulating power fluid to displace gas from the tubing;
- circulation of the power fluid provided a back-up system for removing any sulphur that may have dropped out from the reservoir fluids in the tubing. Alternative downhole configurations for wells to be exploited with the jet pump system are presented in FIGS. 4A, 4B, 4C, 4D and 4E as follows:
- Jet Pump System in a concentric tubing configuration without chemical injection tubing (FIG. 4A);
- Jet Pump System in a concentric tubing configuration with chemical injection tubing (FIG. 4B);
- Jet Pump System in a parallel tubing configuration without chemical injection (FIG. 4C);
- Jet Pump System in a parallel tubing configuration with chemical injection (FIG. 4D);
- Jet Pump System in a parallel tubing configuration with a power fluid bypass (FIG. 4E).

Chemical injection via an independent chemical injection line can be used for several purposes including injection of hydrate temperature depressants, corrosion inhibitors, sulphur solvents, and for downhole pressure monitoring with an inert& gas in the manner of a bubble tube. When used for the injection of sulphur solvent the chemical injection line provides a supplemental method of preventing sulphur deposition. This is especially useful during well start up, clean up, and other transient flow periods. Dimethyl disulphide (DMDS) has been shown to be a superior sulphur solvent that is suitable for injection via a chemical injection system when mixed with a suitable corrosion inhibitor. Other dialkyl disulphides can also be used as a sulphur solvent.

The chemical injection line can be made of threaded tubing sections connected together to run from the surface to the level of the packer or annular seal between the casing and tubing or it can be made from continuous tube. Typically, the threaded tubing sections will have an outside diameter exceeding 19 mm. The continuous tube will typically have an outside diameter of 19 mm or less. Where desirable more than one string of continuous chemical injection tubing can be installed in the well. Multiple strings of continuous chemical injection tubing can be encapsulated in an elastomer sheath. In any case the independent chemical injection pathway should be extended through the annular seal between the casing and tubing. In a preferred embodiment, the chemical injection is arranged so as to channel the chemical to traverse the entire productive interval commingling with the hydrogen sulphide reservoir fluids before entering the tailpipe.

The application of the invention includes but is not limited to the conditioning of sour gas formation fluids for reinjection into the well as jet pumping power fluid and/or sulphur solvent.

The objective of the conditioning stage is to remove the sulphur from the well fluids, to recycle a desulphurated high $H_2S$ concentration fluid into the well, and to produce a sour gas suitable for commercial processing.

Wells producing hydrogen sulphide and sulphur physically dissolved, chemically bound, or existing as elemental sulphur in a solid or liquid state, and equipped in the manner of this invention, requiring large amounts of desulphurated high hydrogen sulphide fluids as sulphur solvent, would require a reservoir fluid recycling process. An example of a reservoir fluid recycling process for a reservoir containing 90% $H_2S$ is shown in FIG. 5.

The recycling process works as follows:

- produced fluids leave the wellhead and pass to a choke bath heater;
- the fluids are warmed and depressurized;
- the fluids flow to a processing vessel which is operated at a temperature above the melting point of sulphur and at a pressure sufficiently low to cause the sulphur to drop out of the gas;
- liquid sulphur is drained from the processing vessel, passed through a degasser, and is stockpiled as elemental sulphur in liquid or solid form. The gas released from the degasser is sent through a compressor to be boosted to pipeline pressure as required.
- desulphurated sour gas which is to be used for jet pumping power fluid or sulphur solvent is drawn from the processing vessel, passed through a cooler, and goes to a pump. The pump raises the pressure of desulphurated sour fluid to a level suitable for injection into the well as power fluid or sulphur solvent.
- the balance of the desulphurated sour gas is drawn from the processing vessel by a separate line, passed through a choke for a pressure reduction down to that of the pipeline and flows off to a gas plant or other facility.

The operating pressure of the processing vessel should be optimized after considering the phase behaviour and sulphur carrying capacity of the reservoir fluids as well as the wellhead pressure, the pipeline pressure, and the re-injection pressure. The desulphurization of the produced formation fluids will be more complete if the processing vessel is operated at low pressure, and also the potential of further sulphur dropout in the pipeline will be reduced However, depending on the initial sulphur saturation levels, near 100% desulphurization of the gas may not be required for adequate performance as a sulphur solvent or to eliminate sulphur dropout in pipelines. Operation of the processing vessel at high pressure and thus achieving only partial desulphurization of the produced well fluids has the advantage of maintaining a high pressure for feeding into the pipeline and for reducing the pressure increase required from the injection pump connected to the well. The advantage of conserving the pressure of the desulphurated high hydrogen sulphide fluid must be compared with the increase in sulphur solvent injection rates and the increase in the risk of sulphur dropout for specific well conditions in order to select the preferred operating pressure of the processing vessel.

The conditioning of sour gas formation fluids for reinjection in a well as jet pumping power fluid or sulphur solvent as described above is applicable to a well of any $H_2S$ concentration. However, it will be easiest to achieve when the $H_2S$ rich liquid phase can be obtained without cooling the fluids below the ambient temperature or the hydrate temperature for the fluid. Typically, the conditioning process will be acceptable for sour gas wells with $H_2S$ content exceeding 50%.

In another embodiment of the invention there is included at least one downhole heater located either in the producing tubing or in an auxiliary tubing, parallel with the production tubing. The advantages of a downhole heat source are as follows:

- eliminates the need for a short or a long conventional heater string and related surface equipment for hot fluid circulation;
- eliminates the need for the circulation of large quantities of hot fluids intended to dissolve elemental sulphur and reduce sulphur deposition;
- significantly reduces the solvent requirements which are a major expense for production and has potential to eliminate the need for solvent in some cases (including the elimination of sulphur solvent transport, injection and regeneration);
- contributes to an optimum regime for production by heating the produced fluid to a preselected temperature;
- permits the heating of the well prior to production and/or permits intermittent production when necessary;
- could provide heat to the production interval during production, stimulation, injection or shut-in or pulsed shut-in, and in any operation when necessary;
- there are no special requirements for the annular space, hence it can be filled with any suitable inhibited fluid, or with nitrogen which can be used as heat insulation of the tubing string or for gaslift or other artificial lift systems which require a circulating fluid.

In downhole heating using an electrical cable, the cable type heaters are retrievable and are seated in a seating profile installed in the auxiliary tubing. The downhole heaters can be connected at any time to a cable, which is run in the auxiliary tubing string, being completely isolated from the hydrogen sulphide fluid. Downhole configurations using cable type heaters in conjunction with jet pumps are exemplified in the FIGS. 6A and 6B of the attached drawings.

In this type of downhole heating, the above-mentioned auxiliary tubing string can be used for:

- the injection of any material to dissolve sulphur, mitigate hydrate formation, and combat corrosion; a side pocket mandrel (or several) could be incorporated to permit the simultaneous injection of fluids, and heating as necessary;

for observation/monitoring of bottom hole conditions, such as: pressure, temperature and density;
for servicing the electrical cable without pulling the tubing;
for circulation and well killing;
for an alternate production string in certain circumstances.

Alternately, the downhole heater could be powered by an electrical circuit between different concentric tubular strings as mentioned above. In this type of downhole heating, a concentric auxiliary tubing configuration can also be used and has the same multiple functions as the single auxiliary tubing configuration. The advantages of the concentric auxiliary tubings are practically the same as the advantages of the single auxiliary tubing configuration as described above. The concentric case offers the additional advantage of electricity transmission via the concentric tubulars instead of via cable (if the electrical cable causes difficulties). The electrical current running through the tubing can also cause beneficial heating of the tubing itself.

Downhole configurations using an electrical circuit between concentric tubular strings are exemplified in FIGS. 7A, 7B, 7C, 70 and 7E of the attached drawings.

Although only two types of heating systems were exemplified above: one via cable and the other via concentric tubulars, this invention is not restricted to the use of these two heating systems only. A person skilled in the art could adapt, accordingly, any suitable heating system for generating heat downhole.

The method for producing gas from reservoirs containing hydrogen sulphide presented in this invention has the following unique features:

(a) The production wells are equipped with a jet pump including a dual tubular downhole configuration without a conventional separate heater string: one tubular string (insulated or uninsulated) is mainly for production; the second tubular string, insulated or not, could be used for the following purposes: providing heating for the producing fluids, providing an access for injecting any type of fluid (including different types of solvents, corrosion inhibitors, and hydrate temperature depressants) providing a conduit for circulation when necessary, an alternate production string as necessary, and providing an access for downhole observation tools with or without surface readouts.

(b) The jet pump system allows the use of several different types of power fluid, including recycled hydrogen sulphide fluids for which a special processing scheme is used, as described in the text.

(c) This method is flexible, permitting cyclical, intermittent, pulsing or continuous exploitation of the producing zone.

(d) This method permits periodic stimulation-production cycles using, for stimulation, suitable hot solvent type fluids with corresponding additives for combatting adverse phenomena, such as hydrate formation and corrosion when producing sour fluids. Also, hydraulic and/or stress fracturing, using corresponding hot fluids for particular formations (such as carbonates, sandstones) could be applied. Also, the injection of hot solvents in combination with acidizing or acid fracturing could increase the benefits of stimulation in carbonate formations. This system will also allow for heating the reservoir zone adjacent to the wellbore, with heaters known to people skilled in the art. This bottom hole heating could be combined with periods of injection, production, shut-in or pulsed shut-in, where short periods of injection or production interrupt the shut-in periods.

(e) This method could accommodate the drilling, completion and the exploitation of open or cased hole, special deviated or horizontal wells better than the conventional system, eliminating the conventional heater string.

It is understood that all necessary safety rules and standards will be applied and also, special procedures, material specifications and quality assurance programs will be performed and applied to ensure that the operations are programmed, designed and conducted in a prudent and safe manner for this new type of well-reservoir exploitation system.

Although the present invention has been described herein with reference to particular embodiments thereof, it will be appreciated by persons skilled in the art that various changes and modifications can be made in the process and/or in the jet pump assembly which is used therein, without departing from the spirit and scope of the invention. It is therefore intended that the present invention not be limited only to the particular embodiments specifically described hereinabove, but only by the claims which follow.

We claim:

1. A method of substantially preventing deposition of sulphur from fluids containing hydrogen sulphide and sulphur on elements of a well, which penetrates a subterranean reservoir, during extraction of the reservoir fluids through the well, the well comprising:

an outer tubular casing;
first and second fluid pathways which are disposed within the outer casing;
an extraction interval comprising an opening in the outer casing for permitting entry of the reservoir fluids into the well;
an annular seal disposed within the outer casing above said extraction interval;
a jet pump disposed within said first fluid pathway and located above said annular seal;
a tailpipe in communication with said first fluid pathway and extending below said annular seal to said extraction interval at a depth below the point of entry of the reservoir fluids into the well;
a chemical injection tubing disposed within the outer casing and extending to a depth below said annular seal, at a depth below the point of entry of the reservoir fluids into the well, wherein the method comprises:
(i) injecting power fluid into said second fluid pathway;
(ii) injecting a sulphur solvent into said chemical injection tubing for circulating said injected sulphur solvent with the reservoir fluids;
(iii) driving said jet pump with said power fluid which enters said jet pump from said second fluid pathway and is commingled with and entrains the reservoir fluids to cause said commingled fluids to flow to the surface through said first fluid pathway;
whereby a pressurizing action of said jet pump retains sulphur in a dissolved, non-plugging state within said commingled fluids and a liquid film is formed on surfaces of said first fluid pathway which impedes and substantially prevents the deposition of sulphur upon the surfaces of said first fluid pathway.

2. The method of claim 1, wherein said power fluid is selected from the group consisting of: mixed hydrocarbons, light oil; hydrocarbon condensate; water; water mixed with surfactant agents; sulphur solvent; dimethyl disulphide; hydrogen sulphide; fluid rich in hydrogen sulphide; and conditioned, recycled well effluent.

3. The method of claim 1, wherein at least one separate chemical injection tubing string in addition to said chemical injection tubing is disposed within the outer casing, said additional separate chemical injection tubing string for additional chemical injection and monitoring bottomhole pressure.

4. The method of claim 1, wherein a separate chemical injection tubing is installed within the outer casing and connected to one of said fluid pathways for chemical injection therethrough.

5. The method of claim 1, wherein said power fluid is heated on the surface.

6. The method of claim 1, further comprising the steps selected from the group consisting of:

adding a hydrate temperature depressant to said power fluid;

adding a sulphide solvent of said power fluid;

adding dimethyl disulphide to said power fluid;

mixing said sulphur solvent to said power fluid;

injecting a hydrate temperature depressant into a separate chemical injection tubing line.

7. The method of claim 1, wherein said sulphur solvent comprises dimethyl disulphide.

8. The method of claim 1, wherein tubing strings are electrically insulated from each other or from any other tubular string in the well and at least one electrical downhole heater is installed above and below said jet pump and powered by an electrical circuit disposed between the tubing strings.

9. The method of claim 1, the well further comprising at least one electrical downhole heater disposed above and below said jet pump, said heater installed below said jet pump and said heater installed above said jet pump being powered by one or more electrical cables from the surface which are externally attached to one or more of said fluid pathways.

10. The method of claim 1, the well further comprising an auxiliary tubing string located within the outer casing and extending through said annular seal through which a downhole electrical heater is run and powered by an electrical cable inside said auxiliary tubing string, said downhole electrical heater being disposed in a tailpipe of said auxiliary tubing string near said extraction interval.

11. The method of claim 1, the well further comprising an additional pair of auxiliary tubing strings electrically insulated from each other and said fluid pathways in the well and arranged in a concentric configuration which is parallel to said fluid pathways, said auxiliary tubing strings extending through said annular seal and having a tailpipe assembly in which is located at least one downhole electrical heater powered by an electrical circuit disposed between said auxiliary tubing strings.

12. The method of claim 1, the well further comprising elements selected from the group consisting of:

at least one subsurface safety valve disposed above said jet pump;

a flow check device disposed below said jet pump for preventing the drainage of fluids therethrough;

a subsurface safety valve disposed below said jet pump;

a subsurface safety valve disposed in said tailpipe below said annular seal;

at least one corrosion coupon disposed in the well;

an electronic device disposed in the well above or below said jet pump for measuring pressure, temperature or fluid density; and a standing valve disposed below said jet pump for allowing fluids to rise therethrough and for preventing downward flow of all fluids.

13. A method of substantially preventing deposition of sulphur from fluids containing hydrogen sulphide and sulphur on elements of a well, which penetrates a subterranean reservoir, during extraction of the reservoir fluids through the well, the well comprising:

an outer tubular casing;

inner and outer concentric tubing strings which are disposed within the outer casing;

an extraction interval comprising an opening in the outer casing for permitting entry of the reservoir fluids into the well;

a first annular seal disposed within a first annulus between the casing and said outer tubing string above said extraction interval;

a jet pump disposed within said inner tubing string and located above said first annular seal;

a second annular seal disposed within a second annulus between said inner tubing string and said outer tubing string and located below said jet pump;

a tailpipe in communication with said inner tubing string and extending below said first annular seal to said extraction interval at a depth below the point of entry of the reservoir fluids into the well;

a chemical injection tubing disposed within said first annulus and extending to a depth below said first annular seal, at a depth below the point of entry of the reservoir fluids into the well, wherein the method comprises:

(i) injecting power fluid into said second annulus;

(ii) injecting a sulphur solvent into said chemical injection tubing for circulating said injected sulphur solvent with the reservoir fluids;

(iii) driving said jet pump with said power fluid which enters said jet pump from said second annulus and is commingled with and entrains the reservoir fluids to cause said commingled fluids to flow to the surface through said inner tubing string;

whereby a pressurizing action of said jet pump retains sulphur in a dissolved, non-plugging state within said commingled fluids and a liquid film is formed on an inner surface of said inner tubing string which impedes and substantially prevents the deposition of sulphur upon the inner surface of said inner tubing string.

14. The method of claim 13, wherein said power fluid is selected from the group consisting of: mixed hydrocarbons; light oil; hydrocarbon condensate; water; water mixed with surfactant agents; sulphur solvent; dimethyl disulphide; hydrogen sulphide; fluid rich in hydrogen sulphide; and conditioned, recycled well effluent.

15. The method of claim 13, wherein at least one separate chemical injection tubing string in addition to said chemical injection tubing is disposed within the outer casing, said additional separate chemical injection tubing string for additional chemical injection and monitoring bottomhole pressure.

16. The method of claim 13, further comprising the steps selected from the group consisting of:
adding a hydrate temperature depressant to said power fluid;
adding a sulphide solvent to said power fluid;
adding dimethyl disulphide to said power fluid;
mixing said sulphur solvent with a corrosion inhibitor; and
injecting a hydrate temperature depressant into a separate injection tubing line.

17. The method of claim 13, the well further comprising at least one electrical downhole heater disposed above and below said jet pump, said heater installed below said jet pump and said heater installed above said jet pump being powered by one or more electrical cables from the surface which are externally attached to one ore more of the tubing strings, the tubing strings being electrically insulated from each other and from other tubular strings within the outer casing.

18. The method of claim 13, the well further comprising an additional pair of auxiliary tubing strings electrically insulated from each other and the tubing strings and arranged in a concentric configuration which is parallel to the tubing strings, said auxiliary tubing strings extending through said annular seal and having a tailpipe assembly in which is located at least one downhole electrical heater powered by an electrical circuit disposed between said auxiliary tubing strings.

19. The method of claim 13, the well further comprising elements selected from the group consisting of:
at least one subsurface safety valve disposed above said jet pump;
a flow check device disposed below said jet pump for preventing the drainage of fluids therethrough;
a subsurface safety valve disposed below said jet pump;
a subsurface safety valve disposed in said tailpipe below said annular seal;
at least one corrosion coupon disposed in the well;
an electronic device disposed in the well above or below said jet pump for measuring pressure, temperature or fluid density; and
a standing valve disposed below said jet pump for allowing fluids to rise therethrough and for preventing downward flow of all fluids.

20. A method of substantially preventing deposition of sulphur from fluids containing hydrogen sulphide and sulphur on elements of a well, which penetrates a subterranean reservoir, during extraction of the reservoir fluids through the well, the well comprising:
an outer tubular casing;
first and second nonconcentric, parallel tubing strings which are disposed within the outer casing;
an extraction interval comprising an opening in the well casing for permitting entry of the reservoir fluids into the well;
an annular seal disposed within the outer casing above said extraction interval;
a jet pump disposed within said first tubing string and located above said annular seal;
a tailpipe in communication with said first tubing string and extending below said first annular seal to said extraction interval at a depth below the point of entry of the reservoir fluids into the well;
a chemical injection tubing disposed within the casing and extending to a depth below said annular seal, at a depth below the point of entry of the reservoir fluids into the well, wherein the method comprises:
(i) injecting power fluid into said second tubing string;
(ii) injecting a sulphur solvent into said chemical injection tubing for circulating said injected sulphur solvent with the reservoir fluids;
(iii) driving said jet pump with said power fluid which enters said jet pump from said second tubing string and is commingled with and entrains the reservoir fluids to cause said commingled fluids to flow to the surface through said first tubing string;
whereby a pressurizing action of said jet pump retains sulphur in a dissolved, non-plugging state within said commingled fluids and a liquid film is formed on an inner surface of said first tubing string which impedes and substantially prevents the deposition of sulphur upon the inner surface of said first tubing string.

21. The method of claim 20, wherein said power fluid is selected from the group consisting of: mixed hydrocarbons; light oil; hydrocarbon condensate; water; water mixed with surfactant agents; sulphur solvent; dimethyl disulphide; hydrogen sulphide; fluid rich in hydrogen sulphide; and conditioned, recycled well effluent.

22. The method of claim 20, wherein at least one separate chemical injection tubing string in addition to said chemical injection tubing is disposed within the outer casing, said additional separate chemical injection tubing string for additional chemical injection and monitoring bottomhole pressure.

23. The method of claim 20, further comprising the steps selected from the group consisting of:
adding a hydrate temperature depressant to said power fluid;
adding a sulphide solvent to said power fluid;
adding dimethyl disulphide to said power fluid;
mixing said sulphur solvent with a corrosion inhibitor; and
injecting a hydrate temperature depressant into a separate injection tubing line.

24. The method of claim 20, the well further comprising at least one electrical downhole heater disposed above and below said jet pump, said heater installed below said jet pump and said heater installed above said jet pump being powered by one or more electrical cables from the surface which are externally attached to one or more of the tubing strings, the tubing strings being electrically insulated from each other and from other tubular strings within the outer casing.

25. The method of claim 20, the well further comprising an additional pair of auxiliary tubing strings electrically insulated from each other and the tubing strings in the well and arranged in a concentric configuration which is parallel to the tubing strings, said auxiliary tubing strings extending through said annular seal and having a tailpipe assembly in which is located at least one downhole electrical heater powered by an electrical circuit disposed between said auxiliary tubing strings.

26. The method of claim 20, the well further comprising elements selected from the group consisting of:
at least one subsurface safety valve disposed above said jet pump;
a flow check device disposed below said jet pump for preventing the drainage of fluids therethrough;

a subsurface safety valve disposed below said jet pump;

a subsurface safety valve disposed in said tailpipe below said annular seal;

at least one corrosion coupon disposed in the well;

an electronic device disposed in the well above or below said jet pump for measuring pressure, temperature or fluid density; and a standing valve disposed below said jet pump for allowing fluids to rise therethrough and for preventing downward flow of all fluids.

27. An apparatus for substantially preventing deposition of sulphur from fluids containing hydrogen sulphide and sulphur on elements of a well, which penetrates a subterranean reservoir, during extraction of the reservoir fluids through the well, the well comprising:

an outer tubular casing;

first and second fluid pathways which are disposed within the outer casing;

an extraction interval comprising an opening in the outer casing for permitting entry of the reservoir fluids into the well;

an annular seal disposed within the outer casing above said extraction interval;

a jet pump disposed within said first tubing string and located above said annular seal, said jet pump for being driven by power fluid which enters said jet pump from said second fluid pathway and is commingled with and entrains the reservoir fluids through a throat of said jet pump into a diffuser where a velocity of said commingled fluids is reduced and pressure increases, said commingled fluid velocity being sufficient to expel said commingled fluids from said jet pump and to cause said commingled fluids to flow to the surface through said first fluid pathway;

a tailpipe in communication with said first fluid pathway and extending below said annular seal to said extraction interval at a depth below the point of entry of the reservoir fluids into the well; and a chemical injection tubing disposed within the outer casing and extending to a depth below said annular seal, at a depth below the point of entry of the reservoir fluids into the well;

whereby a pressurizing action of said jet pump retains sulphur in a dissolved, non-plugging state within said commingled fluids and a liquid film is formed on surfaces of said first fluid pathway for impeding and substantially preventing deposition of sulphur upon the surfaces of said first fluid pathway.

28. The apparatus of claim 27, further comprising an encapsulated chemical injection tubing arrangement with at least two independent lines, one for chemical injection and the second for bottomhole pressure monitoring, said lines being connected to a chemical injection head on said annular seal and communicating to the depth below said annular seal such that the function of each of said lines can be interchanged.

29. The apparatus of claim 27, further comprising an auxiliary tubing string disposed within the casing parallel to said fluid pathways and extending through said annular seal, through which a downhole electrical heater is powered by a power cable, said heater being situated in a tailpipe of said auxiliary string near said extraction interval.

30. The apparatus of claim 27, wherein said jet pump has a nozzle to throat area ratio ranging from 0.144 to 0.517.

31. The apparatus of claim 27, further comprising an encapsulated chemical injecting tubing disposed within the outer casing, said encapsulated chemical injection tubing having multiple lines, at least one of said lines being for chemical injection and the remaining of said lines being for purposes such as bottomhole pressure monitoring, said lines being connected to a chemical injection head on said annular seal and communicating to the depth below said annular seal such that the function of each of said lines can be interchanged.

32. The apparatus of claim 27, further comprising a standing valve disposed below said jet pump for allowing the reservoir fluids to rise in said first fluid pathway and preventing downward fluid flow.

33. The apparatus of claim 32, further comprising a corrosion monitoring device.

34. The apparatus of claim 33, wherein said corrosion monitoring device comprises a first set of corrosion coupons disposed below said standing valve and a second set of corrosion coupons disposed at the surface.

* * * * *